US011847893B2

(12) United States Patent
Watkins et al.

(10) Patent No.: US 11,847,893 B2
(45) Date of Patent: Dec. 19, 2023

(54) GAMING MACHINE AND METHOD WITH CONTROL OUTCOMES IN BONUS GAMES HAVING BONUS PRIZE TIERS

(71) Applicant: Everi Games, Inc., Austin, TX (US)

(72) Inventors: Brian Watkins, Austin, TX (US); Dustin Dies, Spring, TX (US); Patrick Creamer, Austin, TX (US)

(73) Assignee: Everi Games Inc., Austin, TX (US)

( * ) Notice: Subject to any disclaimer, the term of this patent is extended or adjusted under 35 U.S.C. 154(b) by 0 days.

(21) Appl. No.: 17/155,802

(22) Filed: Jan. 22, 2021

(65) Prior Publication Data

US 2022/0237986 A1 Jul. 28, 2022

(51) Int. Cl.
*G07F 17/32* (2006.01)

(52) U.S. Cl.
CPC ..... *G07F 17/3267* (2013.01); *G07F 17/329* (2013.01); *G07F 17/3211* (2013.01)

(58) Field of Classification Search
CPC .. G07F 17/3258; G07F 17/34; G07F 17/3267; G07F 17/329; G07F 17/3211
See application file for complete search history.

(56) References Cited

U.S. PATENT DOCUMENTS

| | | | | |
|---|---|---|---|---|
| 5,788,573 | A * | 8/1998 | Baerlocher | G07F 17/3258 463/16 |
| 8,100,761 | B2 * | 1/2012 | Bennett | G07F 17/3244 463/16 |
| 8,460,082 | B2 * | 6/2013 | Harris | G07F 17/34 463/19 |
| 2019/0026974 | A1 * | 1/2019 | Casey | G07F 17/3258 |

* cited by examiner

*Primary Examiner* — David L Lewis
*Assistant Examiner* — Robert E Mosser
(74) *Attorney, Agent, or Firm* — Nathan H. Calvert; The Culbertson Group, P.C.

(57) ABSTRACT

A gaming machine, method, and program product provide a slot machine game with a tiered bonus feature. A bonus feature includes a bonus feature prize selector and a bonus feature control selector. The bonus feature prize selector selects a current prize, and the bonus feature control selector selects a control outcome governing bonus feature prize selector. The control outcome may be awarding a current bonus prize selected or upgrading the current bonus prize selected on the first bonus wheel. In response to the upgrading outcome being selected, the bonus feature prize selector is made to select a replacement current prize from among a subset of the number of bonus feature prize tiers comprising each bonus feature prize tier having a value higher than prior value of the current prize.

17 Claims, 20 Drawing Sheets

GAMING MACHINE AND METHOD WITH CONTROL OUTCOMES IN BONUS GAMES HAVING BONUS PRIZE TIERS

FIELD OF THE INVENTION

This invention relates to gaming systems and to gaming machines through which players may participate in wagering games, and in particular gaming machines including games with tiered bonus prizes.

BACKGROUND

Many different types of gaming machines have been developed to provide various formats and graphic presentations for conducting games and presenting game results. For example, numerous mechanical reel-type gaming machines, also known as slot machines, have been developed with different reel configurations, reel symbols, and paylines. More recently, gaming machines have been developed with video monitors that are used to produce simulations of mechanical spinning reels. These video-based gaming machines may use one or more video monitors to provide a wide variety of graphic effects in addition to simulated spinning reels, and may also provide secondary/bonus games using different reel arrangements or entirely different graphics. Many video-based gaming machines have three or five spinning reels that may be stopped to display a matrix of game symbols. The symbols displayed on the stopped reels correlate to a result of the game. Video-based gaming machines may also be used to show card games or various types of competitions such as simulated sporting competitions on which wagers may be placed. A popular use of wagering games is simulated wagering in which money is never involved, and instead points or simulated currency are wagered. Many "virtual casino" websites and smartphone apps employ such a scheme in addition to or instead of money wagering.

Wagering games and particularly bonus level games which are reached after play in a base level game, may have many prize tiers available which each show a potential prize available for the play of the bonus game. A given prize tier may be associated with a progressive prize or a conventional set prize value. Numerous prize tiers ranging from relatively low-value prizes to high-value prizes may provide flexibility in awarding prizes, but also raises the problem how to control the graphic presentation of play in a way that is commensurate with the wide range of available prizes. Bonus games or bonus prize presentations are one way to provide such a wide range of prize tiers.

One problem associated with use of such prize tiers is that players become dissatisfied with bonus games in which the lower-tier prizes are frequently awarded. Such a problem may arise when bonus games are presented with a lot of emphasis on the high value prize tiers that are available, and a visual presentation designed to enhance the excitement of having an opportunity to win such high prizes. Then, over the course of a playing session, if multiple bonus game occur but the player mostly wins prizes from lower-level tiers available in the bonus game, the player may become disillusioned by a feeling that the bonus game does not award higher-tier prizes very frequently, and therefore does not deserve the exciting presentation and is not as lucrative or exciting as it might be. Such feelings may cause players to quit playing a game they might otherwise enjoy.

Game manufacturers are continuously pressed to develop new game presentations, formats, and game graphics in an attempt to provide high entertainment value for players and thereby attract and keep players. What is needed are ways to provide both anticipation and excitement to players consistent with a given prize level to be awarded while providing more variability in game results.

SUMMARY OF THE INVENTION

The present invention encompasses methods for controlling wagering games, gaming machines, and computer programs that provide numerous tiered prizes which are coordinated with graphic presentations to vary the playing experience.

A gaming machine, method, and program product provide a slot machine game with a tiered prize structure with numerous different prizes that may be awarded through a bonus feature. At least some of the different prizes available in the bonus feature may also be awarded outside of the bonus feature, particularly in a base portion of the game.

According to one aspect of the invention, a method for controlling the operation of a gaming machine. The method includes, in response to a play input entered through a player input device of the gaming machine and under control of a processing system of the gaming machine, causing a display system of the gaming machine to display a base result representation in a first area of the display system. While the base result representation is displayed in the first area of the display system and under control of the processing system, the method causes the display system to display a bonus feature prize selector, a bonus feature control selector, and a number of bonus feature prize tiers in a second area of the display system separate from the first area of the display system. In response to a trigger condition for the play input and under control of the processing system, the method causes the display system to display an operation of the bonus feature prize selector to select a current prize from among the number of bonus feature prize tiers, and causes the display system to display an operation of the bonus feature control selector to select a control outcome, the control outcome being selected from a group comprising at least an award outcome and an upgrade outcome. In response to the selected control outcome being the upgrade outcome and under control of the processing system, the bonus feature prize selector is operated again to replace the current prize with a selection from among a subset of the number of bonus feature prize tiers comprising each bonus feature prize tier having a value higher than a prior value of the current prize. In response to the selected control outcome comprising the award outcome the current prize is awarded. The respective bonus prizes may be progressive award prizes.

In some implementations, method includes determining if the base game result representation corresponds to one of the number of bonus feature prize tiers and, if so, awarding a prize associated with the respective bonus feature prize tier in response to the display of the base result representation, the prize associated with the respective bonus feature prize tier being awarded through the gaming machine under control of the processing system.

In some implementations, method includes in response to the selected control outcome comprising the upgrade outcome and under control of the processing system, again causing the display system to display an operation of the bonus feature control selector to select a second control outcome, the second control outcome being selected from the group comprising at least an award outcome and an upgrade outcome. In response to the second control outcome being the upgrade outcome and under control of the processing system, the method causes the bonus feature prize selector to replace the current prize with a selection from among a new subset of the number of bonus feature prize tiers comprising each bonus feature prize tier having a value higher than the updated value of the current prize. In response to the second control outcome being the award outcome and under control of the processing system, the method awards the current prize.

In some implementations, in response to the selected control outcome being the upgrade outcome, the bonus feature control selector is graphically modified to change the selected upgrade outcome to an award outcome.

In some implementations, the method includes, in response to the selected control outcome comprising the upgrade outcome, displaying the bonus feature prize selector being graphically modified to remove one or more prize values equal to or lower than the current prize from the bonus feature prize selector.

The bonus feature prize selector may be a wheel which is spun to select a prize, and the bonus feature control selector is a second wheel which is spun to select a control outcome. Displaying the bonus feature prize selector being graphically modified may include displaying segments of the wheel disappearing and displaying remaining segments growing to fill a greater circumferential span of the wheel.

Another aspect of the invention is a gaming machine including a display system, an audio device, a player input device, and at least one electronic controller operatively coupled to the display system, the audio device and the player input device and configured to execute instructions to perform the method. A tangible, non-transitory electronically accessible memory is connected to the at least one electronic controller and contains program code executable by the at least one electronic controller for performing the method.

Another aspect of the invention is a computer program stored on a non-transitory computer readable medium. The software version is, of course, typically designed to be executed by a gaming machine or networked gaming system. The software includes multiple portions of computer executable code referred to as program code. Gaming results are provided in response to activations and displayed by display program code that generates simulated slot reels each including one or more symbol locations. The program also has game controller program code for determining game play results involving spins or other randomization of primary game presented through a first gaming mode and tired bonus gaming mode game presentations according to the method above.

Another aspect of the invention is a gaming system that includes one or more gaming servers, and a group of electronic gaming machines connected to the servers by a network, programmed to provide one of more of the methods described herein. The various functionality described herein may be distributed between the electronic gaming machines and the gaming servers in any practically functional way. For example, the current preferred architecture is for the servers to determine all aspects of game logic, random number generation, and prize awards. The gaming machines provide functionality of interfacing with the player and animating the game results to present the results received from the server in an entertaining manner. However, other embodiments of course might use a thin client architecture in which the animation is also conducted by the server and electronic gaming machines serve merely as a terminal to receive button or touchscreen input from the player and to display graphics received from the server.

Different features may be included in different versions of the invention. These and other advantages and features of the invention will be apparent from the following description of the preferred embodiments, considered along with the accompanying drawings.

DETAILED DESCRIPTION OF EXAMPLE EMBODIMENTS

Figure 1:
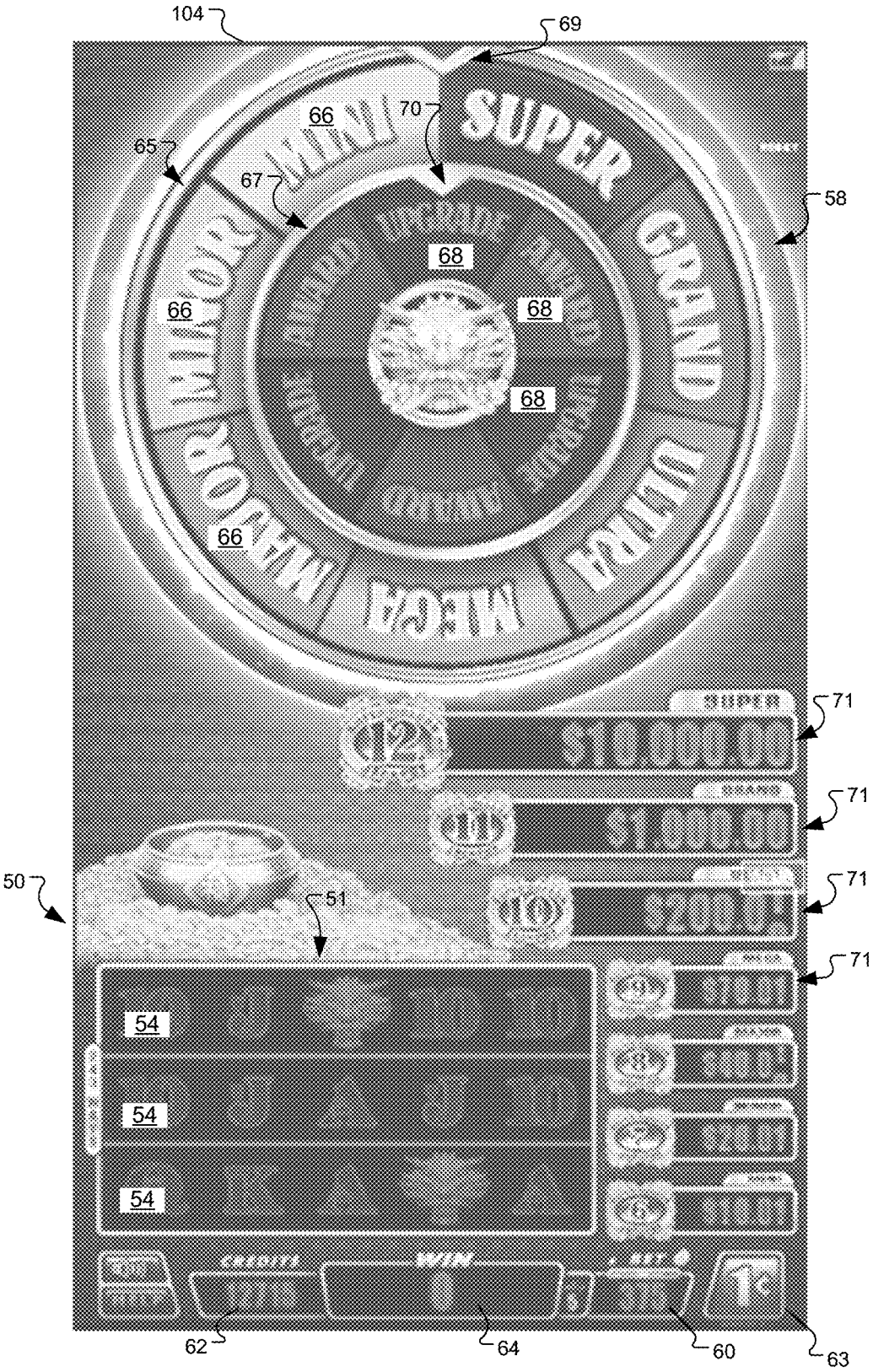
FIG. 1 is a game screen diagram showing a base game mode having multiple game presentations according to an example embodiment.

FIG. 1 is a game screen diagram illustrating a base game mode showing a primary display 104 to illustrate an example slot machine display arrangement on which wagering game results are presented in a primary display area 50, typically found on the primary display. A secondary display area 58 is present on the display 104, typically located toward the top of the display. In versions including multiple displays, secondary display area 58 is typically found on a secondary, upper display.

The primary display area 50 in the depicted mode presents a reel-type primary game (as opposed to bonus games or other feature games as described herein), which in this version includes a matrix 51 of symbol locations 54 arranged in rows and columns to represent simulated slot machine reels that are spun to conduct a game round. Other embodiments may, of course, use other types of game displays to display randomizing of symbols according to the methods herein. The depicted columns of symbols labeled 52 represent the simulated reels, while symbols are shown in each symbol location designated 54. In this instance there are five reels with three symbol locations 54 displayed at a time on each reel, but the game can be played with more and less reels. The simulated reel typically has far more symbols than those displayed, and as many unique stop positions as there are symbols on the simulated reel. The stop position may be counted, for example, by numbering the symbols on the simulated reel and using the number of the symbol at the bottom of the display window (the three symbols displayed in this example), or at the top or middle. Further, while multi-symbol reels are shown, other versions may use simulated uni-symbol reels, or a reel that has many symbols thereon but only a single window to the reel simulated, displaying a single symbol from the reel. Some variations of the present invention may use a simulated uni-symbol reel in each depicted symbol location 54. Winning patterns are typically formed by matching symbols along defined paylines that pass through the matrix 51.

Below matrix 51 are several game interface elements. Box 60 displays the current wager and amount bet per payline. Other versions may not have a designated bet per line. The wager credit denomination is shown in box 63. Box 62 displays the current credits in the player's account. Centrally located is win box 64, which displays the player's last awarded winnings.

Toward the right on primary display 104 is a set of progressive indicators 71, each indicating a current value of a tier level progressive prize from a tiered progressive jackpot game available as a bonus game.

In the scenario depicted, the current state of primary display area 50 and secondary display area 58 includes a bonus event in the primary game that has just activated the progressive bonus game. Secondary display area 58 is activated to show the double wheel bonus display as depicted. The bonus display includes bonus feature prize selector, which in this embodiment is a first bonus wheel 65 including seven segments 66 each associated with a bonus feature prize tier selected by a selector 69 after a wheel spin including bonus wheel 65 spinning and stopping. A bonus feature control selector is also shown, which in this embodiment is a control wheel 67 also appearing on secondary display area 58. While, in this version, the bonus feature prize selector and the bonus feature control selector are embodied as wheels, in other versions other suitable graphic elements may be employed to show randomized selection between multiple elements. Any suitable combination of such graphic elements may be employed. For example, a wheel may be used for the bonus feature prize selector, while a virtual coin flip or other alternate presentation may be employed for the bonus feature control selector. In this embodiment second control wheel 67 is arranged radially inside bonus wheel 65 to spin independently of bonus wheel 65. Control wheel 67 includes segments 68 with at least two different outcomes, an "AWARD" outcome with the effect awarding a current bonus prize selected on the first bonus wheel, and "UPGRADE" outcome with the effect of upgrading the current bonus prize selected on the first bonus wheel. Segments 68 are selected by selector 70 when control wheel 67 is spun and stopped.

FIGS. 2-14 are series of diagram showing a sequence of events for a progressive bonus game presented on a primary display 104. The conduct and progression of the game will be further described with reference to the flowchart of FIG. 15.

Figure 15:
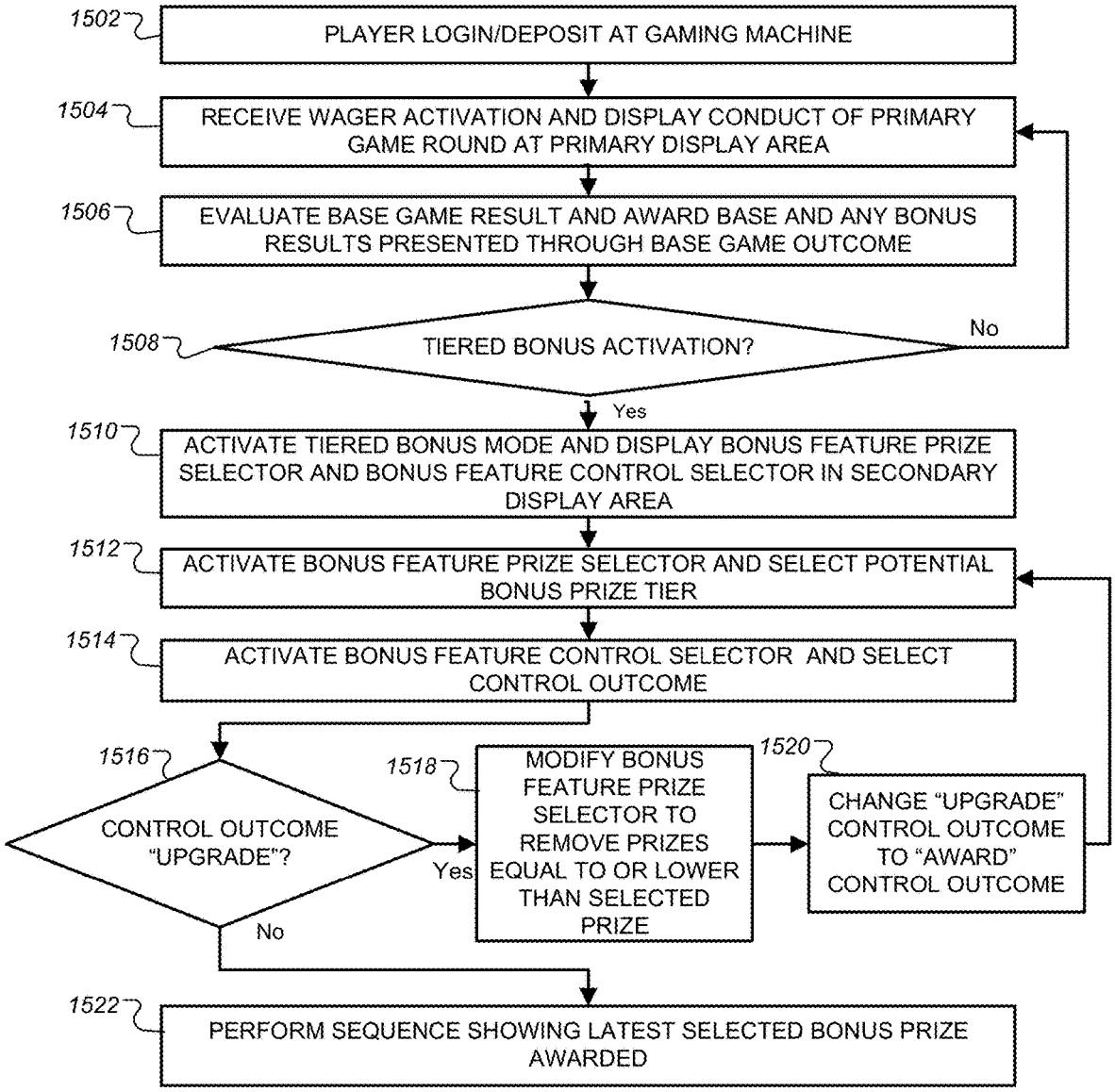
FIG. 15 is a flowchart of a process for conducting a multi-tier bonus game according to some embodiments

FIG. 15 is a flowchart of a process for conducting a multi-tier bonus game according to some embodiments. Generally, the process is conducted under control of one or more electronic processors to present gaming results on one or more displays on a gaming machine such as those described herein. To initialize the game and make it available for wagering, the process starts a game engine software package for executing game code like that depicted in FIG. 17, including loading data structures such as media assets and code for the base game and bonus games. The process of controlling a wagering game for a player starts at block 1502 where a player logs in or deposits money or a credit voucher at a gaming machine. This typically includes receiving the player deposit through a credit input device such as the bill/voucher acceptor 112 (FIG. 16), and in response activating a credit meter value that establishes a player credit balance.

To begin a game play in the first gaming mode, the method receives a wager activation on a player input device at the gaming machine at block 1504, which typically consists of some input from the player to set the amount to be wagered from their credit amount on the machine. The wager amount may also be carried over from previous game rounds by simply starting the game with the previous wager amount set. This typically happens through a 'Play' button (110, FIG. 16) on the game cabinet or touchscreen display, and serves to place the wager and start a single round of game play in the base game at block 1504. In embodiments having reels, reel displays, or simulated reels, this is conducted by spinning the reels. Other embodiments may otherwise rearrange or randomize the symbols on the matrix in any suitable manner.

Figure 17:
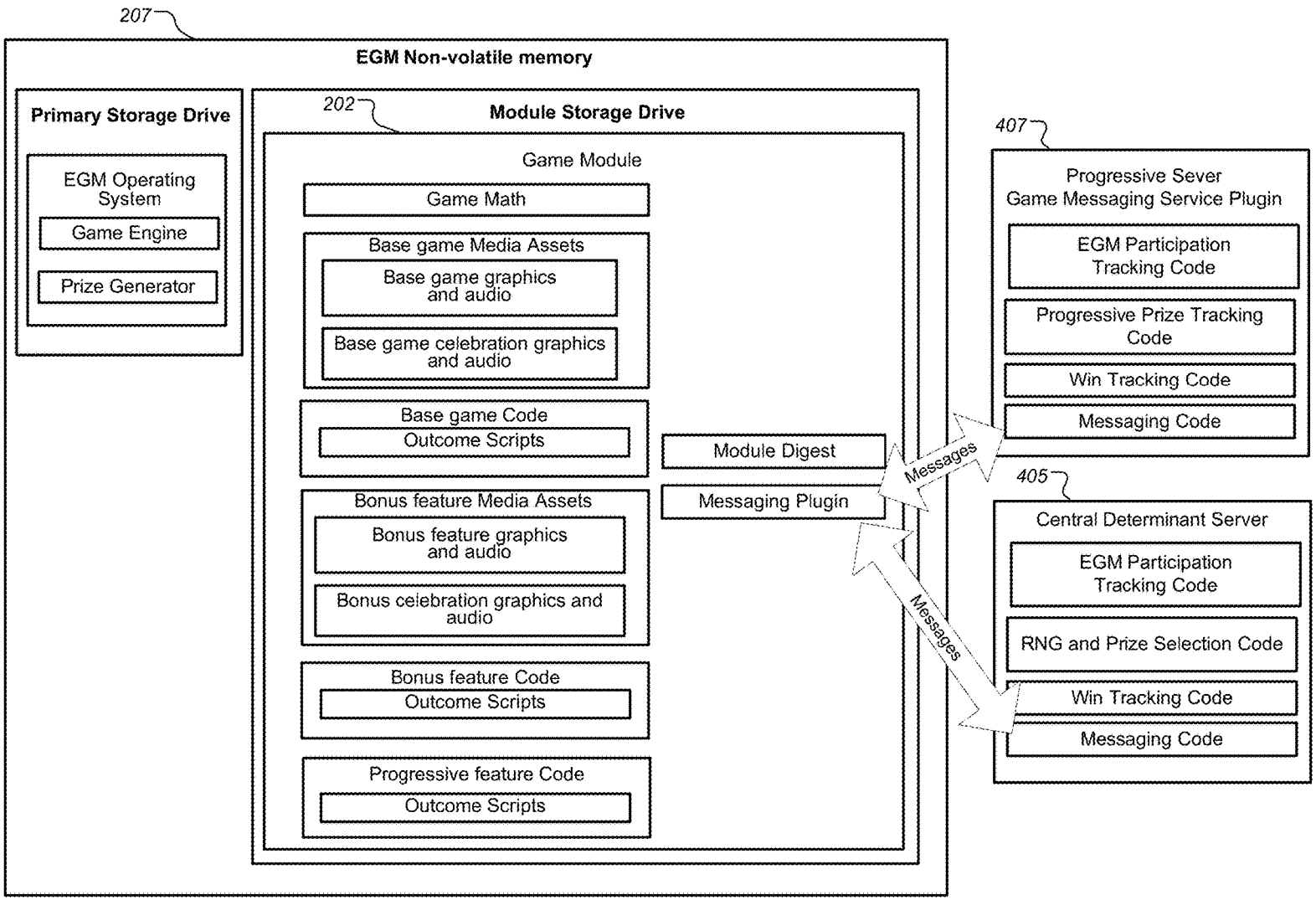
FIG. 17 illustrates in block diagram form a software and data structure design for an electronic gaming machine according to some embodiments.

The preferred version generates at least one random number at block 1504 and uses the at least one random number to select an outcome, which may include a base game prize and a bonus game prize including credits that may have a monetary value or a different type of point value depending on the wagering environment. Then a set of game reel stops or other base game presentation script is selected based on a second random number generation, which is fed to a first data structure for the base game mode (230, FIG. 19) for providing the game presentation. If the outcome includes a bonus prize, an outcome script including commands for controlling the second bonus game mode may be selected. For non-progressive tiered bonuses, a bonus feature code outcome script is selected, while for progressive tiered bonuses, a progressive feature code outcome script is selected (FIG. 17). The game outcome is evaluated at block 1506 by displaying an evaluation of the symbols on the matrix for winning patterns and other winning symbols or combinations thereof. The evaluation may be conducted by an outcome script or directly by the game engine. The game may include multiple bonus features activated by various trigger conditions, but the depicted flowchart deals with the tiered bonus feature. Other bonus feature activations that do not include the tiered bonus game mode are handled at block 1506.

In preferred embodiments, one or more lower tier bonus prizes available in the bonus game below are also available as bonus results from a base game round at block 1506. This feature improves the functioning of the gaming machine by making the lower tier bonus prizes available to be awarded directly from base game results, rather than with a bonus game presentation, allowing a common distribution of tiered prizes with lower-tier bonus prizes being more frequently awarded and presented without a full bonus game presentation. Such an arrangement has the advantage that it avoids creating the problem discussed above that players may become disillusioned with bonus game presentations if they frequently award lower-tier prizes rather than higher-tier prizes. Along with this feature, the bonus game presentation discussed below provides for more frequent higher-tier prizes to be awarded, which also improves the functioning of the gaming machine in achieving its purpose of providing excitement and interest to the players by fulfilling psychological expectations that a bonus round should often result in higher-tier prizes being awarded.

After each primary game round is completed, at block 1508, if a tiered bonus activation has occurred, the process goes to block 1510 where it activates the tiered bonus mode. Data structures for displaying and moving the bonus feature prize selector and bonus feature control selector in the secondary display area, and controlling the game conduct during the tired bonus mode are provided by tiered bonus program code such as the bonus feature code or progressive feature code shown in FIG. 17. An outcome script may be employed to direct operation of the tiered bonus mode. In the present embodiment, a progressive feature outcome script (FIG. 17) is used. In other embodiments, a bonus feature outcome script may be used. If no tiered bonus activation has occurred, the process returns to block 1504 and continues receiving wager activations and providing primary game results.

Figure 2:
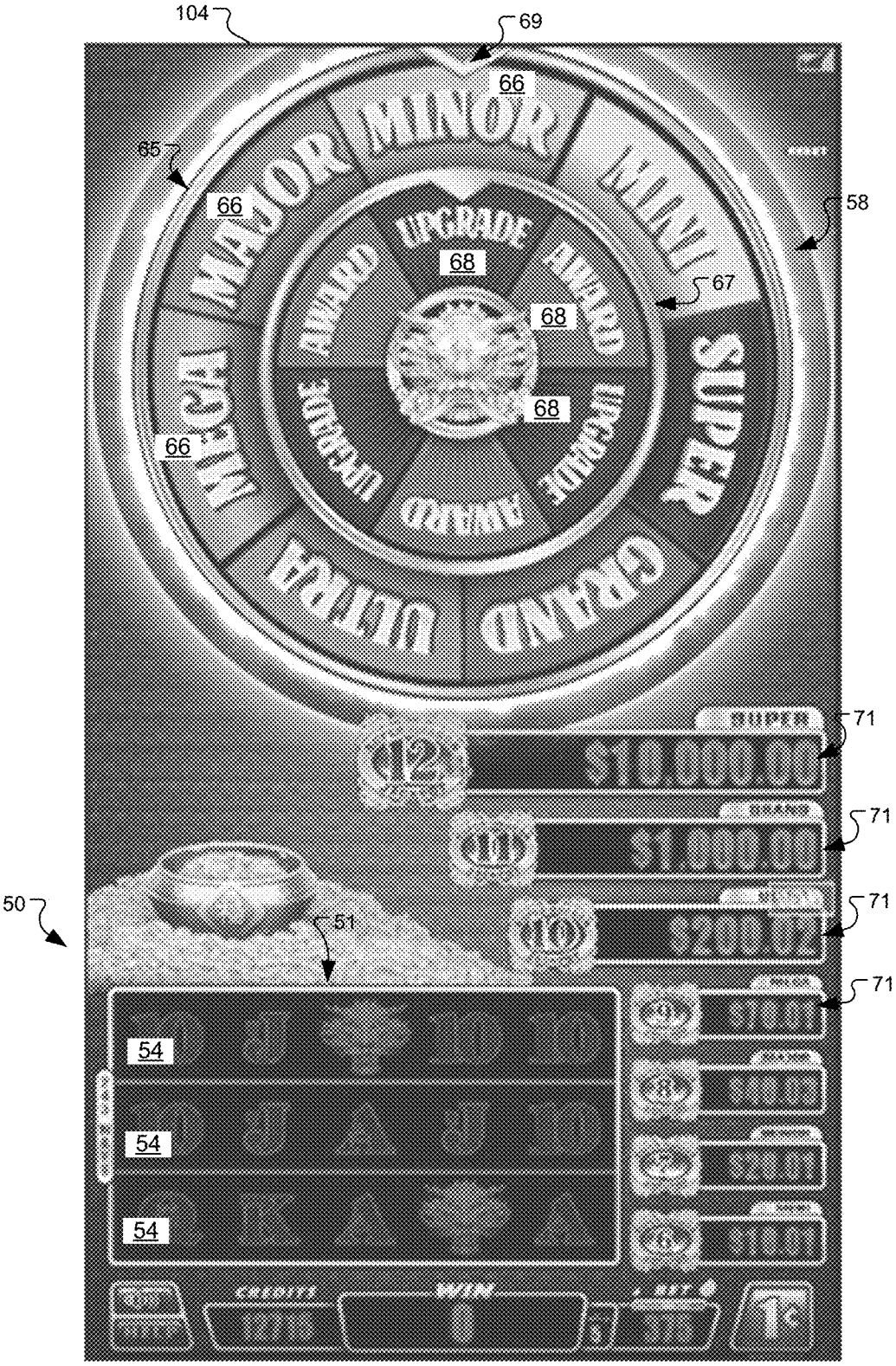
FIGS. 2-14 are series of game screen diagrams showing a sequence of events for a progressive bonus game like that of FIG. 1.

After the tiered bonus mode is activated at block 1510, the process goes to block 1512 where it activates the bonus feature prize selector. This block generally includes displaying an operation of the bonus feature prize selector to select a prize from among the number of bonus feature prize tiers, which in this version is embodied as bonus wheel 65 spinning and stopping to select a potential or current bonus prize based on a selected segment. (The current prize may not be the final prize awarded for the bonus round because of operation of the bonus feature control selector described below.) For alternative embodiments employing a "reels first" mode of operation, a random number is generated and employed to select a stop location for the wheel according to a weighted mapping of wheel locations. FIG. 2 depicts the state of the secondary display area 58 at block 1512, with a "MINOR" prize segment selected on the bonus wheel.

Figure 3:
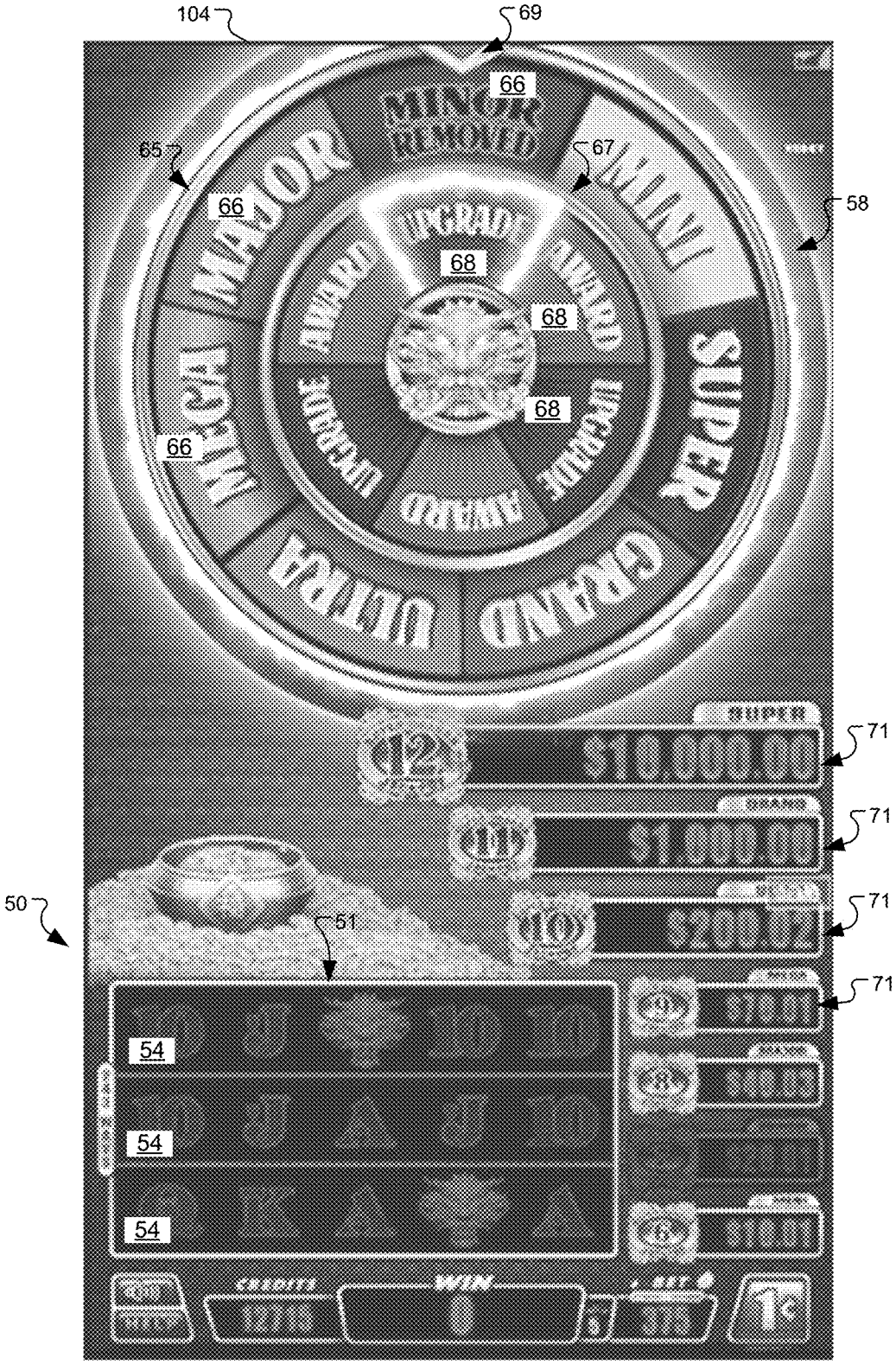

Next at block 1514, the process causes the display system to display an operation of the bonus feature control selector to select a control outcome, which in this version is embodied as control wheel 67 spinning and stopping to select a control outcome governing the first bonus wheel. In this embodiment, the bonus wheel 65 begins spinning at the same time as control wheel 67, but stops before the bonus wheel stops to select a segment. The control outcome is selected from a group including at least outcomes of awarding a current bonus prize selected on the first bonus wheel ("AWARD" segment 68), and upgrading the current bonus prize selected on the first bonus wheel ("UPGRADE" segment 68). FIG. 3 shows the secondary display area with an UPGRADE segment selected at block 1514. In this embodiment, the bonus feature control outcome is provided by a progressive feature code outcome script. For alternative embodiments employing a "reels first" mode of operation, a random number is generated and employed to select a stop location for control wheel 67 according to a weighted mapping of wheel locations.

In response to the selected control outcome comprising the AWARD outcome, as shown at block 1522, the process awards the current prize selected from among the number of bonus feature prize tiers.

In response to the UPGRADE control outcome being selected, at block 1516 the process goes to block 1518 where it causes the bonus feature prize selector modify the two depicted wheels, and return to block 1512 to select a prize from among a subset of the number of bonus feature prize tiers including each bonus feature prize tier having a value higher than the value of the prize selected from among the number of bonus feature prize tiers. In this embodiment, block 1518 modifies the bonus feature prize selector to remove bonus feature prize tiers equal to or lower than the selected prize under control of a progressive feature code outcome script, which commands graphical code objects to perform changes of the displayed wheel. This block may include bonus wheel 65 being graphically modified to remove one or more segments 66 associated with prize values equal to or lower than the current prize from bonus wheel 65, as shown in FIG. 3 with the MINI segment 66 shown in the process of being removed from bonus wheel 65. The progressive indicator 71 for the removed segment is also grayed out at this point to indicate that prize is removed.

Following the modification at block 1518, the process goes to block 1520, where it changes the bonus feature control selector such that the UPGRADE control outcome currently selected is changed to an AWARD control outcome. In this embodiment, block 1520 modifies the bonus feature control selector to under control of a progressive feature code outcome script, which commands graphical code objects to perform changes of the displayed bonus feature control selector and a data array containing values of the outcomes of the bonus feature control selector. In non-progressive embodiments, a similar script is employed which modifies a bonus feature control selector. Other embodiments may not include block 1520, and instead go directly from block 1518 to block 1512.

Figure 4:
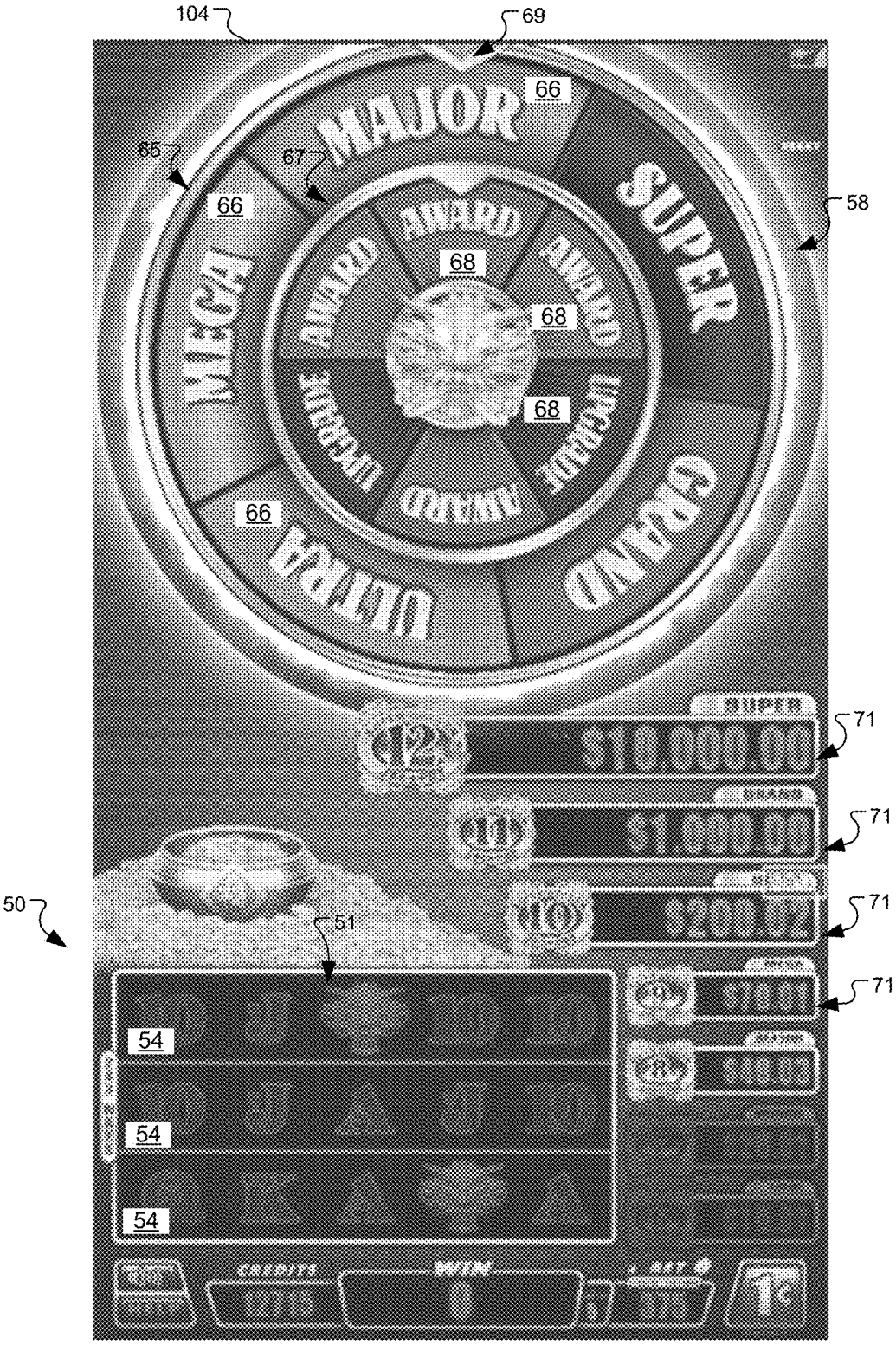
Figure 5:
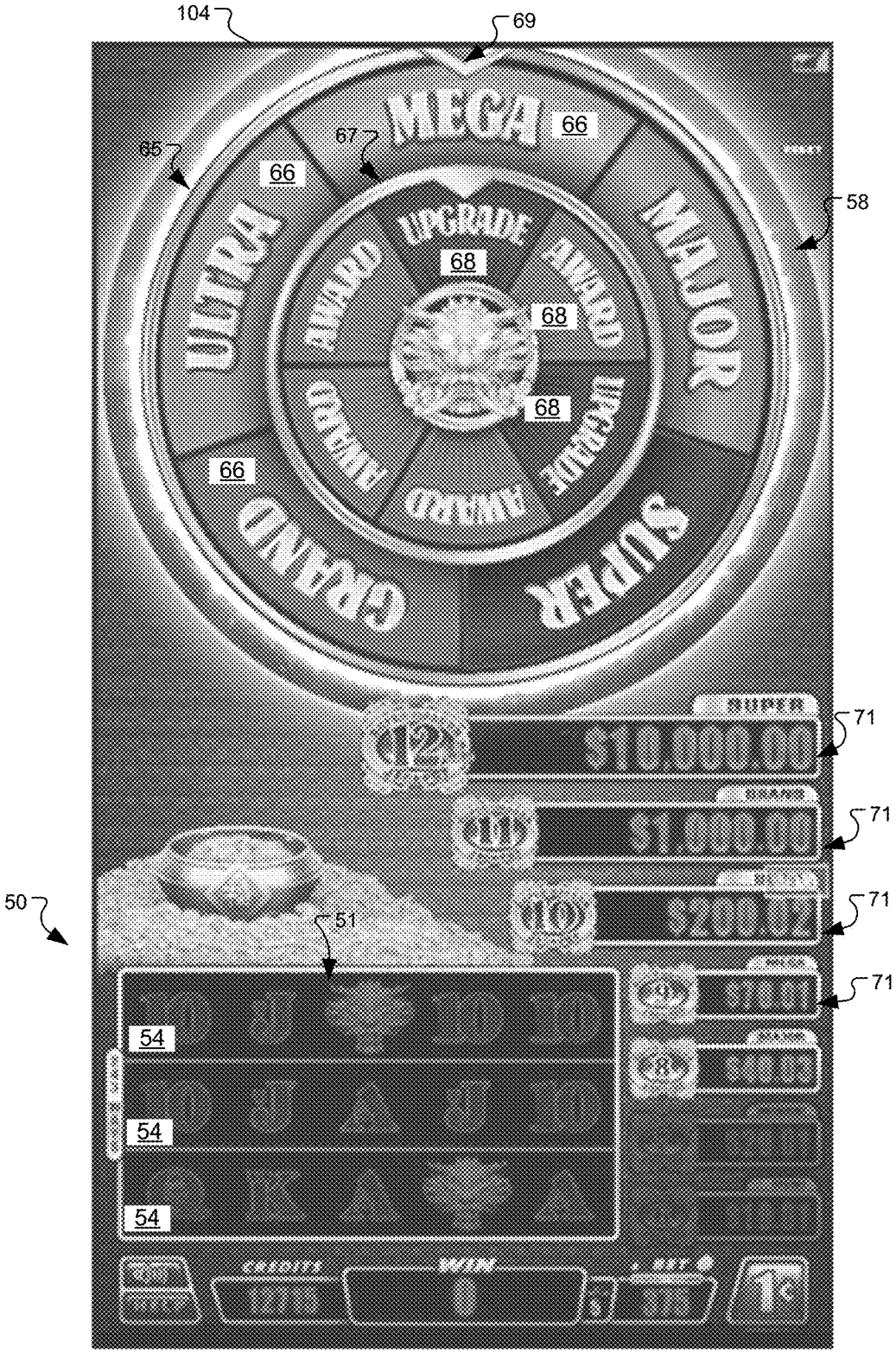
Figure 6:
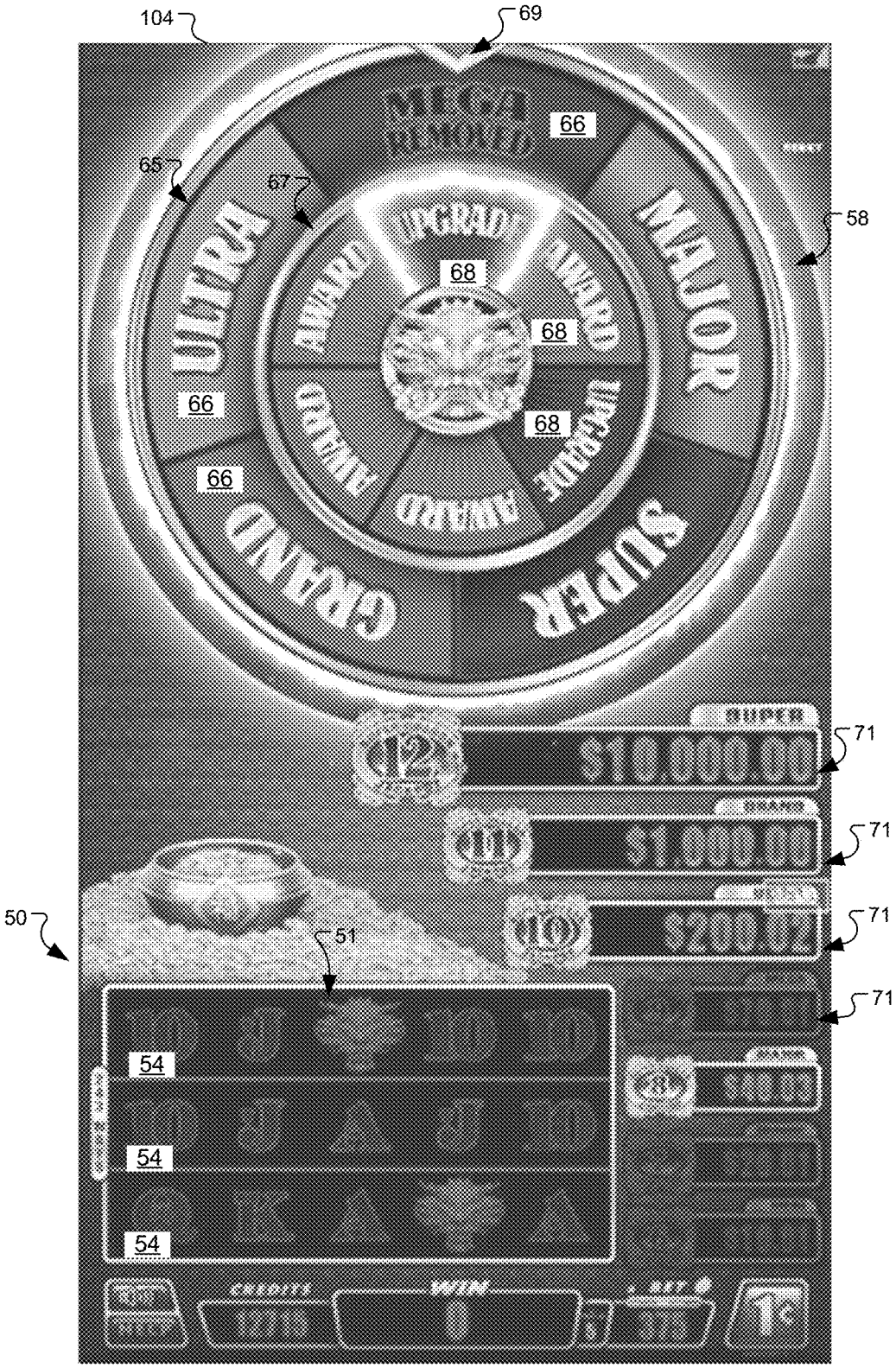
Figure 7:
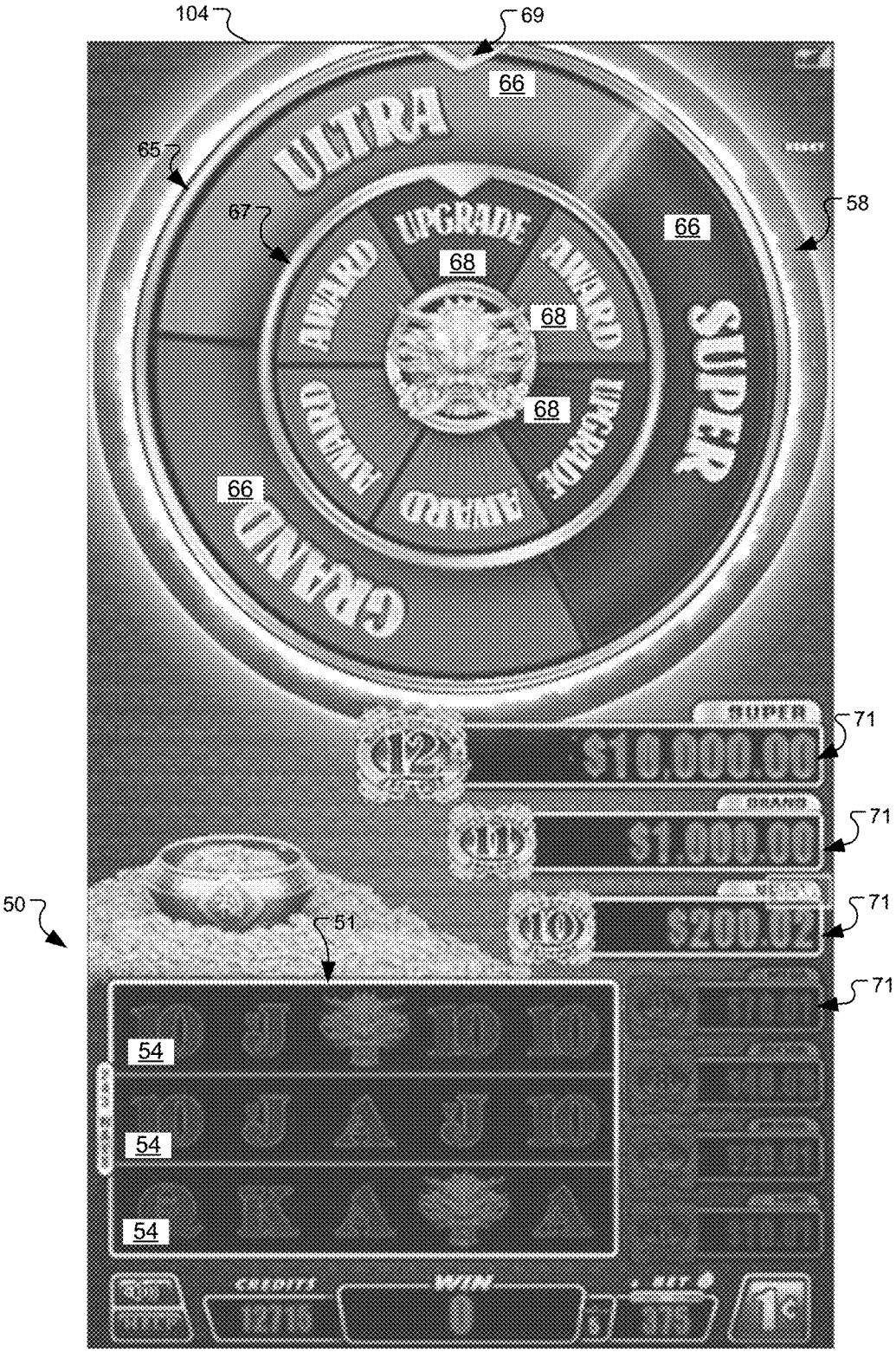
Figure 8:
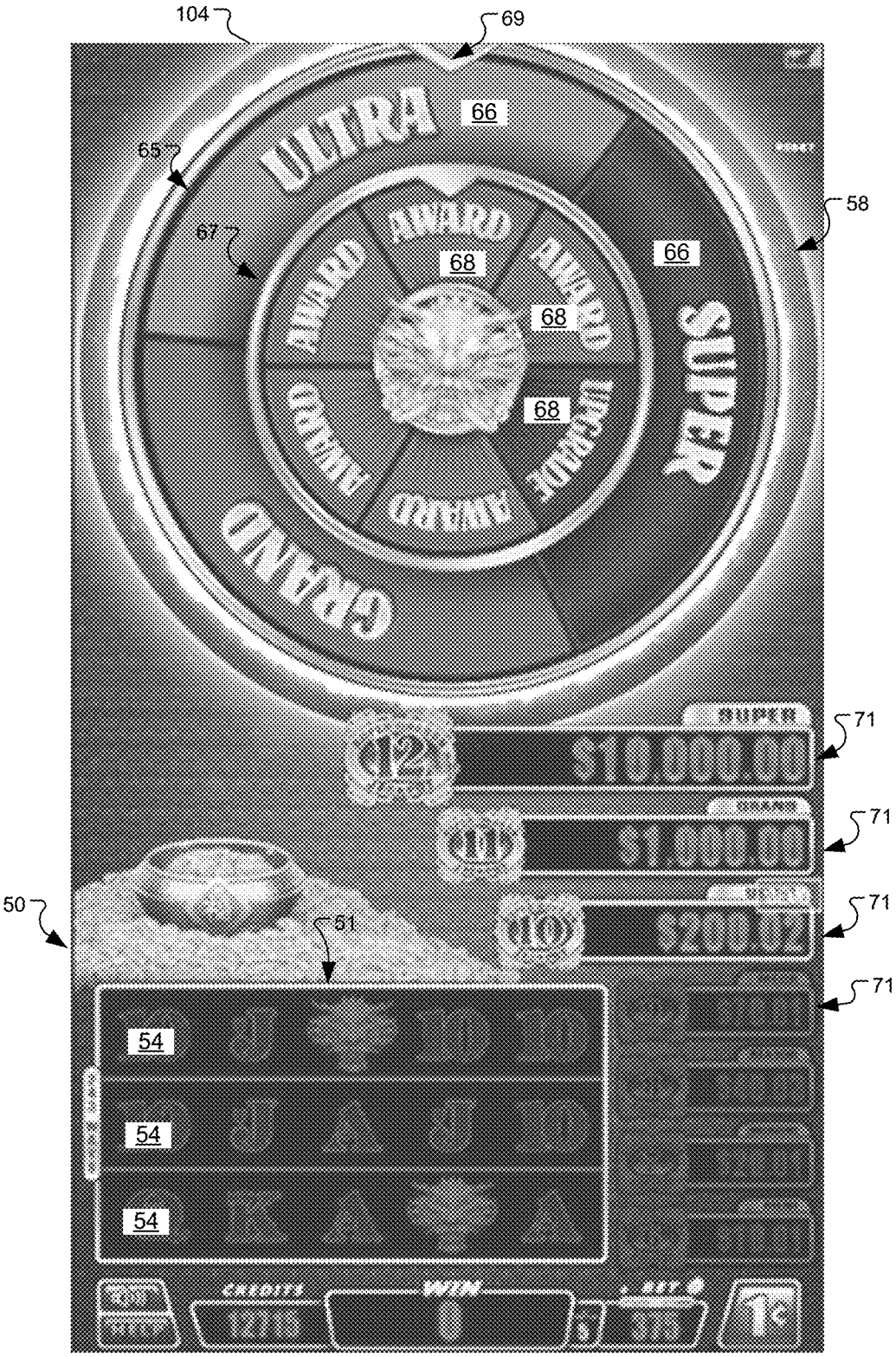
Figure 9:
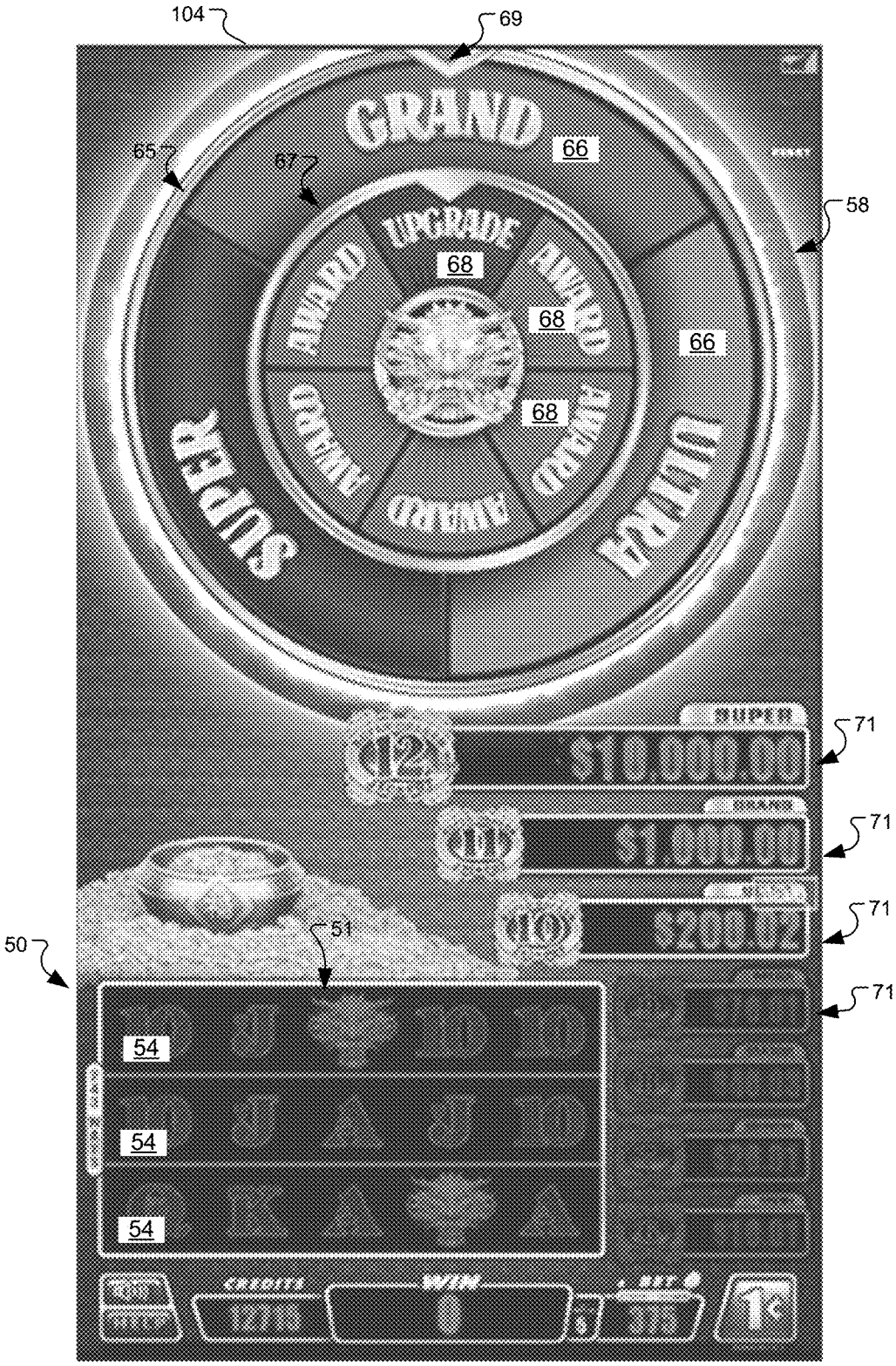
Figure 10:
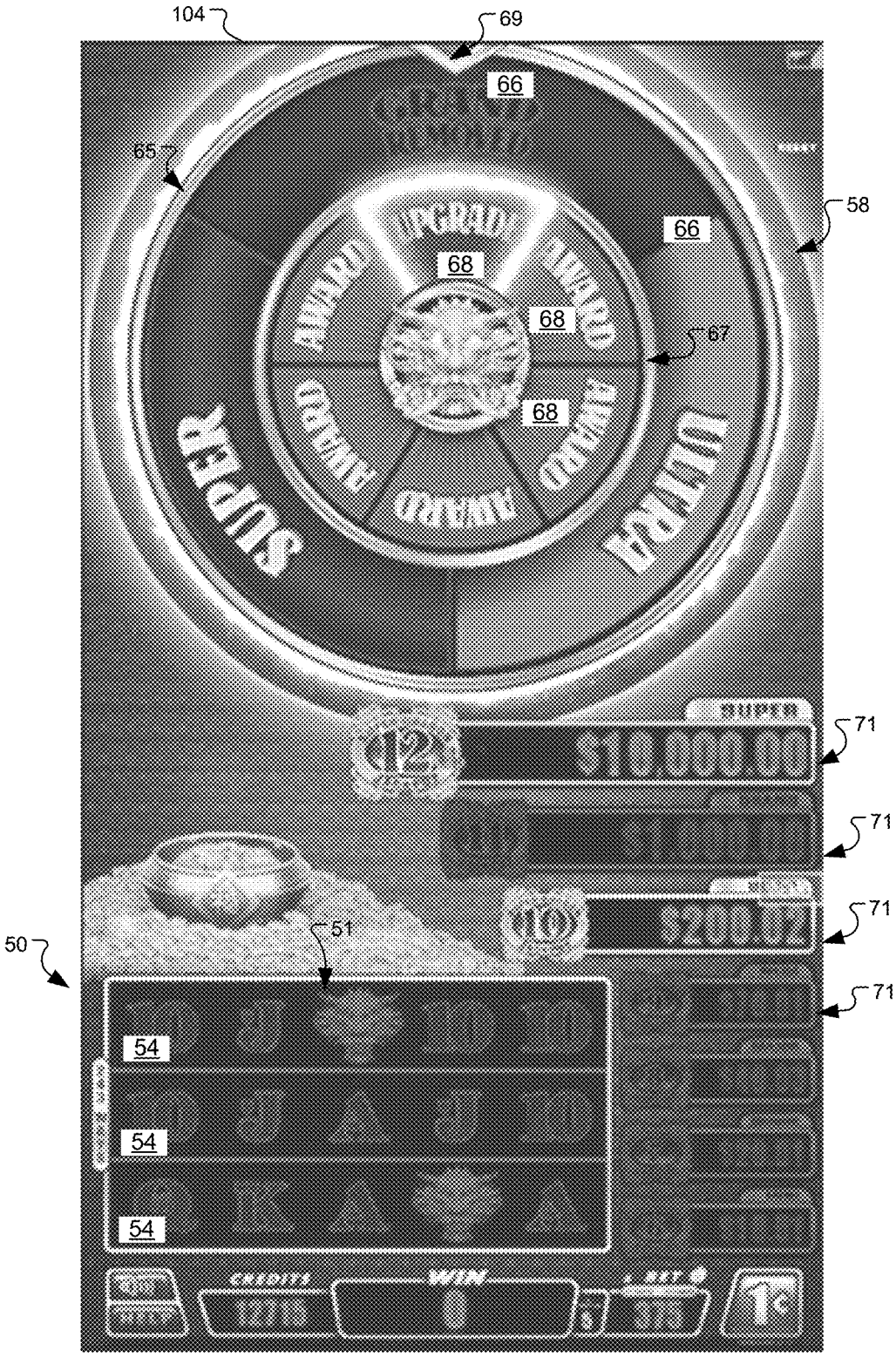
Figure 11:
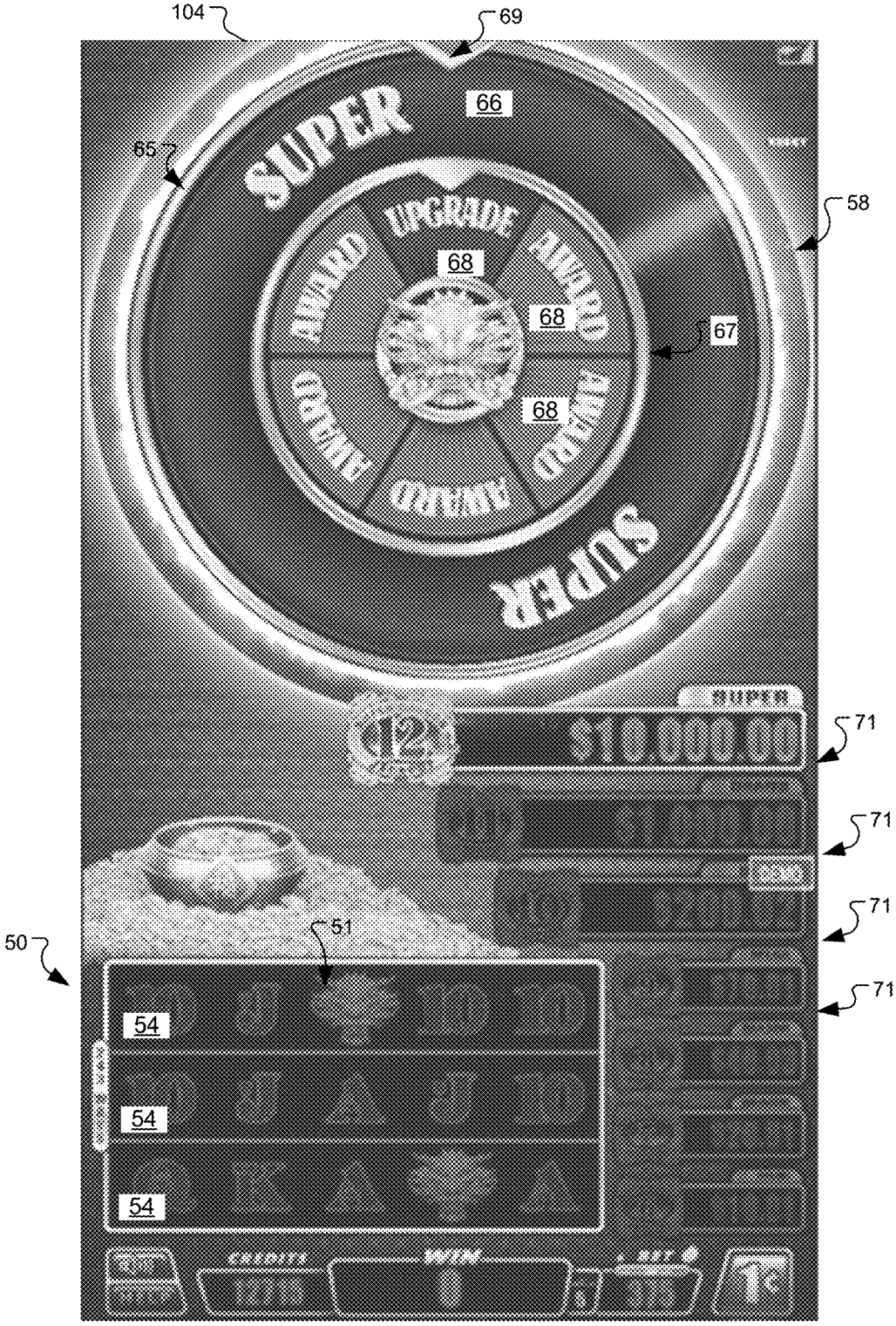

The process then returns to block 1512 to respin bonus wheel 65 to select a replacement prize for the current prize, which has a value higher than the prior value of the current prize. FIG. 4 depicts the bonus wheel being spun following the removal of the MINOR segment 66 from bonus wheel 65, along with a lower-value prize segment, the MINI segment, and the change of the selected UPGRADE control segment 68 to an AWARD control outcome. The progressive indicators 71 are grayed out for these prizes. These changes are preferably animated sequentially such that the player can easily observe the changes occurring on the display. As can be understood from the flowchart of FIG. 15, the UPGRADE control outcome may occur multiple times during a tiered bonus game round, each time successively removing one or more options from the bonus feature prize selectors, which in this version includes removing prize segments from bonus wheel 65. When the AWARD outcome in any of these repeated rounds, the process goes to block 1522 where it awards the current prize. As shown in FIGS. 5 and 6, in the example scenario depicted, a second time through blocks 1512-1516 of the process results in the "MEGA" prize being selected on bonus wheel 65, and then an UPGRADE control outcome selected on control wheel 67. As shown in FIG. 6, the UPGRADE control outcome results in a new prize value selected for the current prize from a new subset of the tiered prizes. This new subset is achieved in FIG. 5 to FIG. 6 by bonus wheel 65 having the MEGA prize segment removed, along with the a lower value prize segment, the MAJOR, leaving bonus wheel 65 with three segments as shown in FIG. 7. Then the control feature bonus selector, in this embodiment control wheel 67, is updated again as shown at block 1520 to change the selected upgrade segment 68 to an award segment, as shown in FIG. 8.

Figure 12:
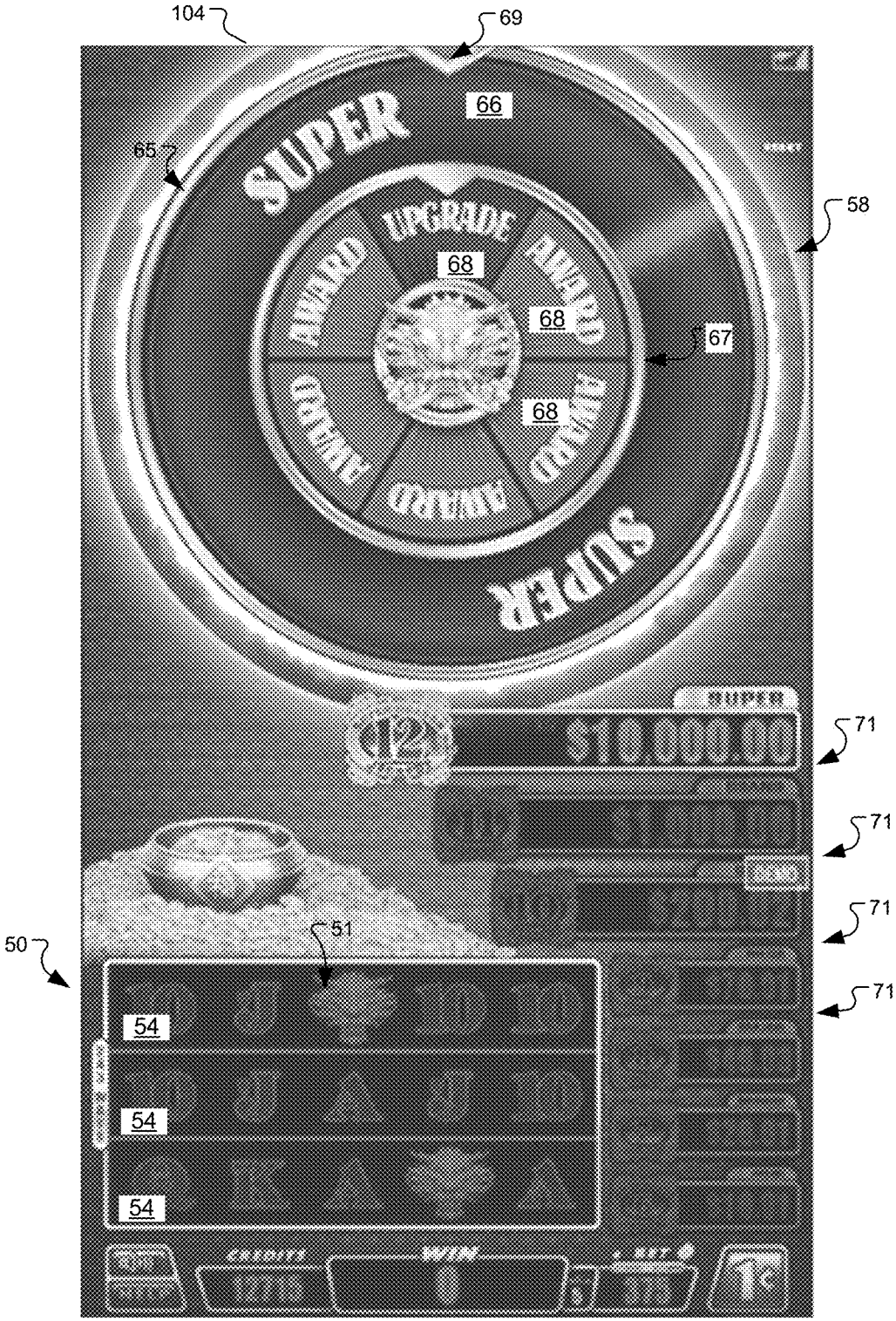
Figure 13:
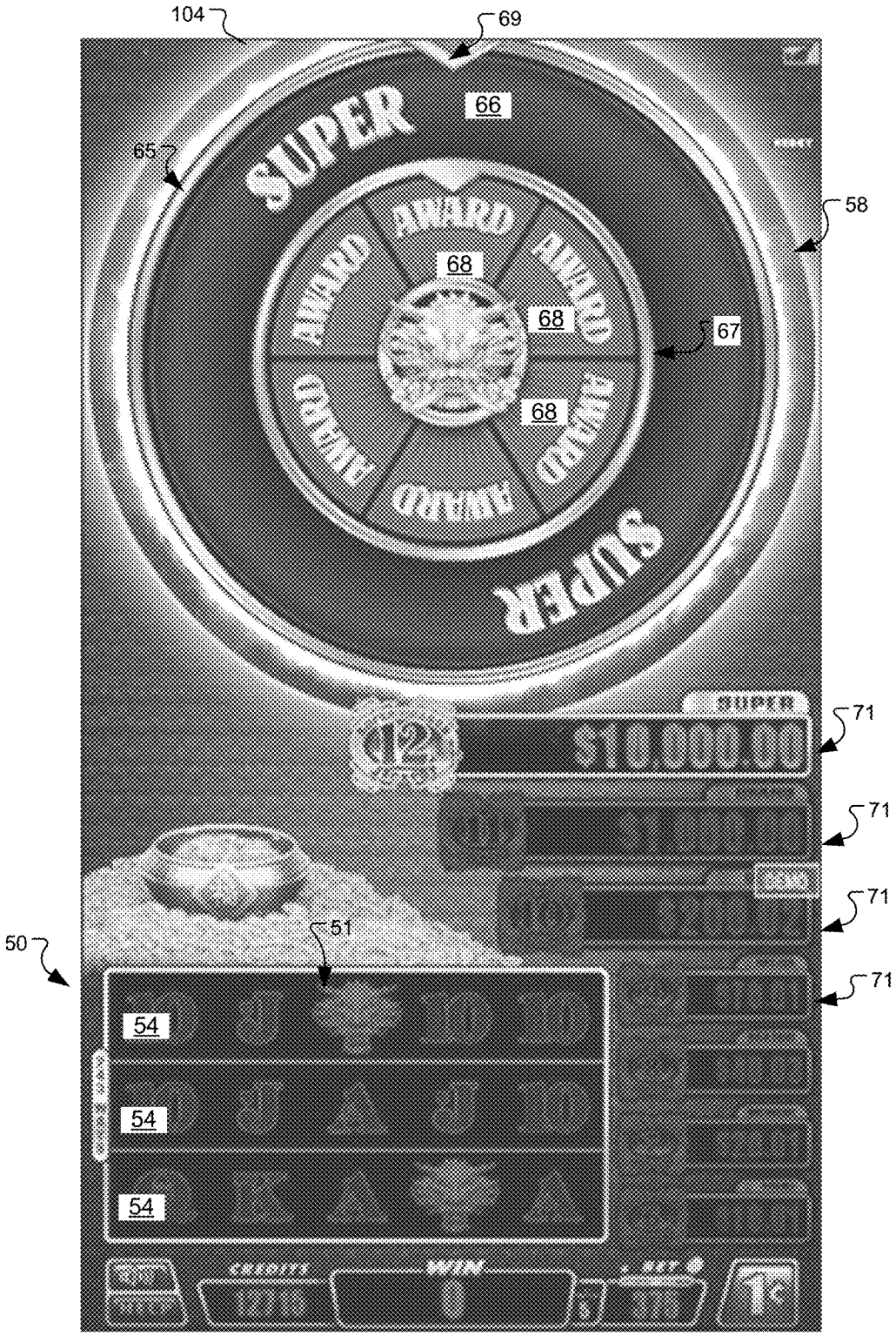
Figure 14:
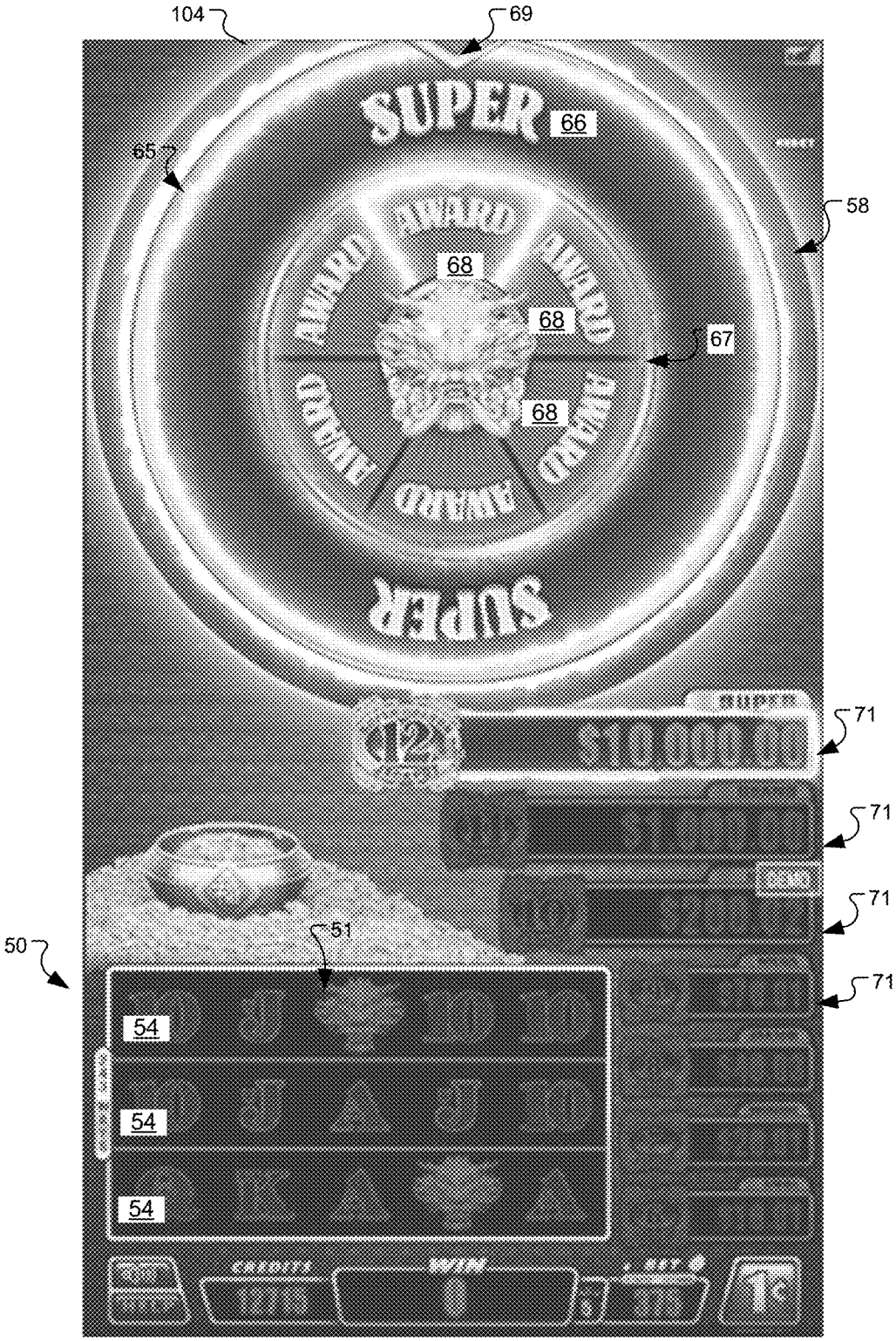

After the modification exemplified in FIG. 7 and FIG. 8, the process again returns to blocks 1512 and 1514 to select a bonus prize segment 66 and a control outcome segment 68. In this scenario, the "GRAND" prize segment 66 is selected, and an UPGRADE control segment 68 is selected, as shown in the example game screen of FIG. 9. This results in the GRAND prize segment being removed, and the lower-value "ULTRA" prize segment being removed (block 1518), as shown in the sequence from FIG. 10 to FIG. 11. This sequence leaves the bonus wheel 65 with only one segment remaining, the "SUPER" prize segment, as shown at FIG. 12. Then the selected UPGRADE segment of control wheel 67 is changed to an award segment (block 1520), leaving control wheel 67 with only AWARD segments, as shown in FIG. 13.

In this scenario, the next spin of the wheels 65 and 67 at blocks 1512 and 1514 results in the SUPER prize segment 66 being selected, and an AWARD control segment 68 being selected. Because an AWARD segment was selected, the process at block 1516 goes to block 1522, where the latest selected bonus prize, the SUPER prize, is awarded.

In this embodiment, the tiered progressive has a series of 7 progressives prizes, "SUPER", "GRAND", "ULTRA", "MEGA", "MAJOR", "MINOR", "MINI", each associated with options of the bonus feature prize selector, with progressive prize values listed from high to low. Other tiered arrangements of fixed tiered or progressive tiered prizes may, of course, be used. While bonus feature control selector of this embodiment includes two options, "UPGRADE" and "AWARD", each appearing multiple times on control wheel 67, other embodiments may include additional control outcomes such as an "AWARD AND UPGRADE" outcome, which causes the current prize to be awarded, and then the bonus feature game continues as if an UPGRADE control outcome was selected. Other types of control outcomes may also be included. While the depicted process in FIGS. 1-14 provides a tiered progressive bonus game, other embodiments provide a tiered bonus that is not a progressive prize following the same process depicted in FIG. 15. For progressive embodiments, the prize as finally awarded at block 1522 may be selected with a random outcome generated separately from the base game outcome, or may be selected as part of the base game outcome. Similarly, non-progressive bonus prizes may be selected by a random outcome generation separate from the base game outcome, or may be part of the base game outcome. When progressive prizes are employed, the tiered prize values are preferably continuously updated through communication with a progressive server.

Figure 16:
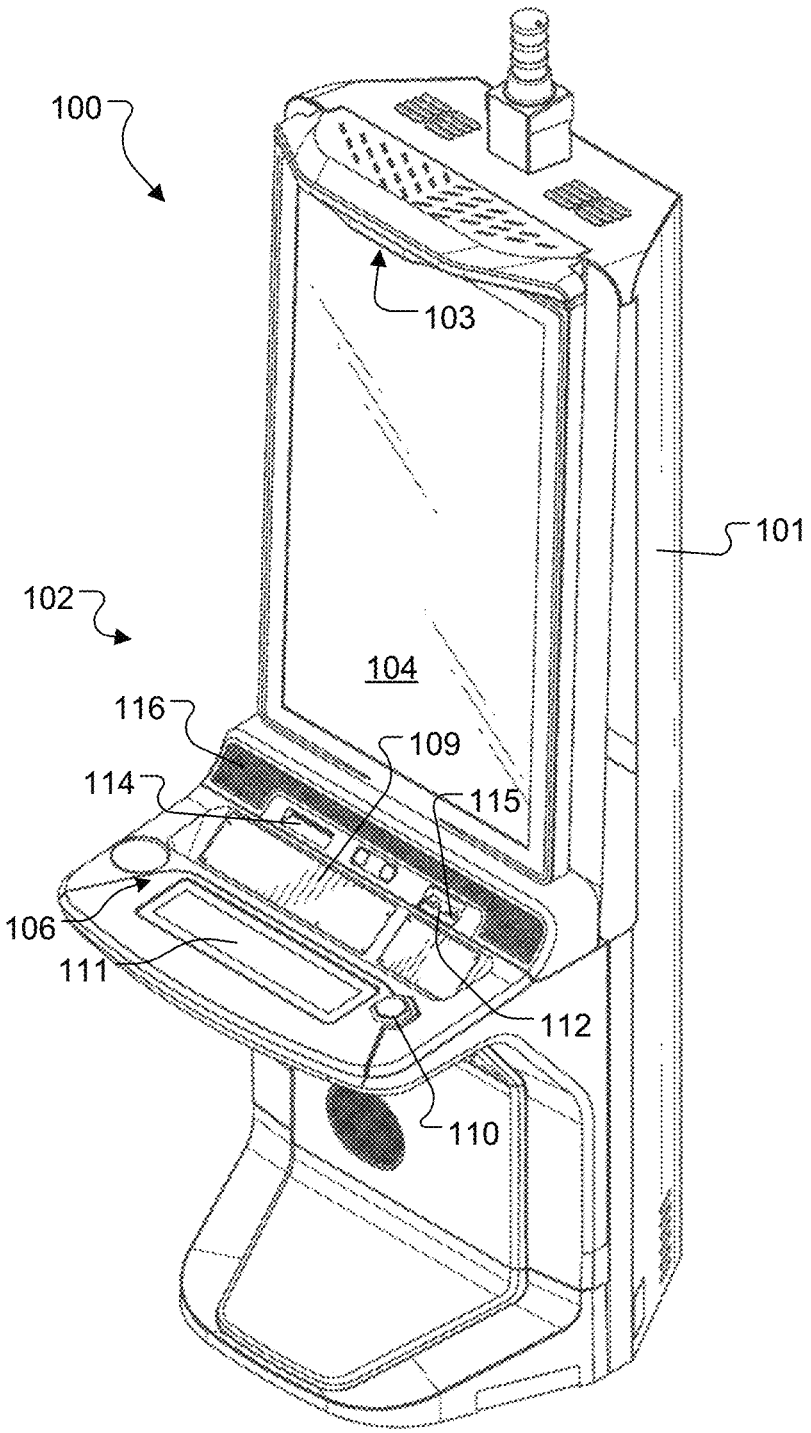
FIG. 16 shows a gaming machine that may be used to implement feature games according to some embodiments.
Figure 19:
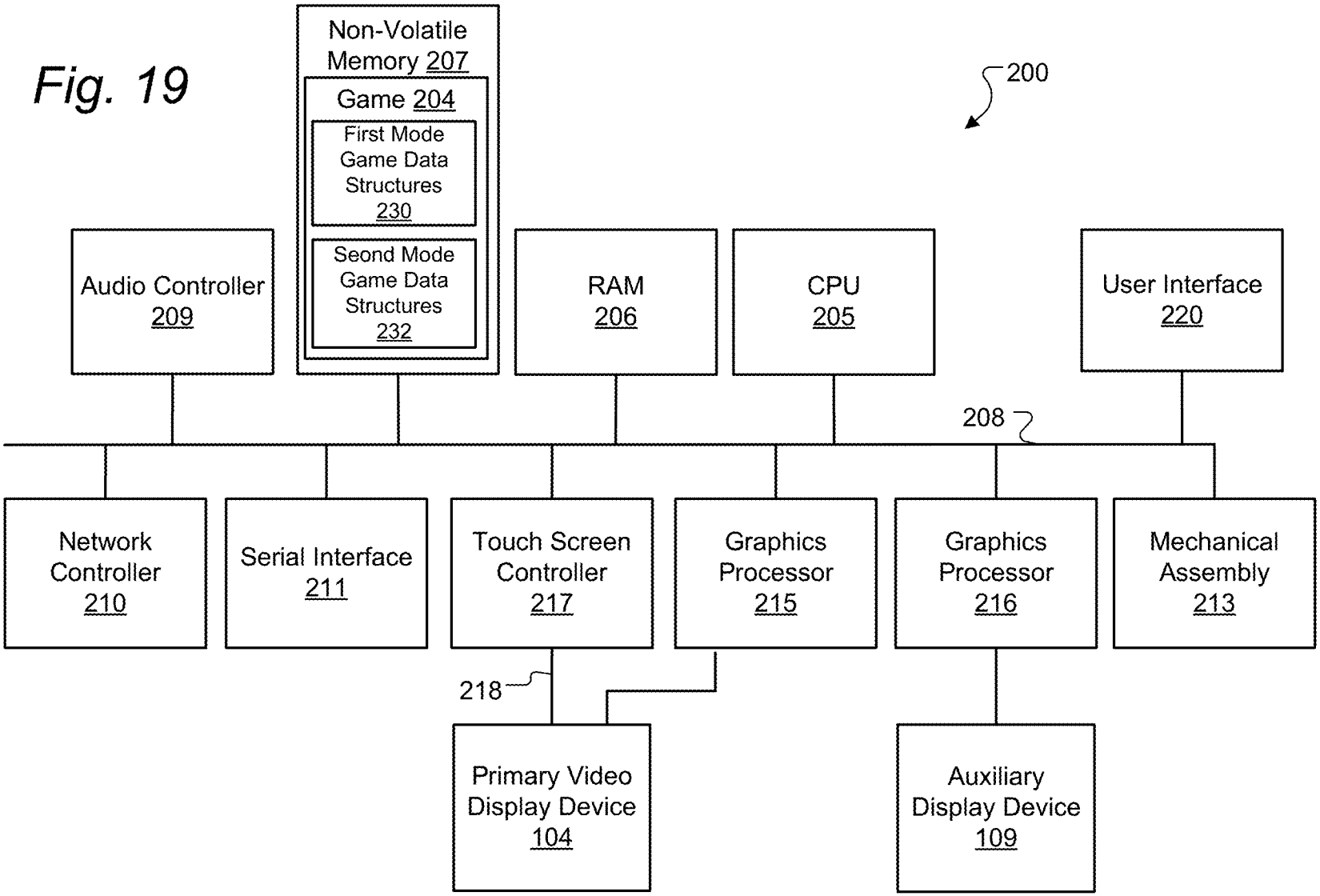
FIG. 19 is a block diagram showing various electronic components of the gaming machine shown in FIG. 16 together with additional gaming system components.

FIG. 16 shows a gaming machine 100 that may be used to implement feature games according to the present invention. The block diagram of FIG. 19 shows further details of gaming machine 100. Referring to FIG. 16, gaming machine 100 includes a cabinet 101 having a front side generally shown at reference numeral 102. Gaming machine 100 includes a display system including one or more display devices such as video displays or mechanical display devices such as spinnable reels or wheels. In the depicted version, the display system includes a primary video display device 104 which is mounted in a central portion of the front side 102, with a ledge 106 positioned below the primary video display device and projecting forwardly from the plane of the primary video display device. Gaming machine 100 also includes two additional smaller auxiliary display devices, and a lower auxiliary display device 109. All of the displays may include touchscreen sensors, especially auxiliary display device 109 which may be used to present touchscreen controls for wagering. It should also be noted that each display device referenced herein may include any suitable display device including a cathode ray tube, liquid crystal display, plasma display, LED display, or any other type of display device currently known or that may be developed in the future.

In preferred versions, the gaming machine 100 illustrated in FIG. 16 also includes a number of mechanical control buttons 110 mounted on ledge 106. These control buttons 110 may allow a player to select a bet level, select paylines, select a type of game or game feature, and activate a play in the primary game. Further, primary video display device 104 in gaming machine 100 provides a convenient display device for implementing touchscreen controls.

Gaming machine 100 may also include a number of other player interface devices in addition to devices that are considered player controls for use in playing a particular game. Ledge 106 may also include a hardware special object including a button, touch sensor, or switches, joysticks, or other mechanical input devices, and/or virtual buttons and other controls implemented on a suitable touchscreen video display. Gaming machine 100 also includes a currency/voucher acceptor 112 having an input ramp, a player card reader having a player card input 114, and a voucher/receipt printer having a voucher/receipt output 115. One or more of these devices provides a credit input device in communication with the controller and adapted for accepting a physical item associated with a monetary value that establishes a player credit balance. Audio speakers 116 generate an audio output to enhance the user's playing experience. Numerous other types of devices may be included in gaming machines that may be used according to the present invention.

FIG. 17 illustrates in block diagram form a software and data structure design for the electronic gaming machine. Illustrated are software are data objects held in non-volatile memories 207 at each of the electronic gaming machines, and related objects at progressive server 407 and central determinant server 405. A primary storage drive holds the EGM operating system and a game engine and may include a prize generator for producing randomized game outcomes, either with a random number generator or by request to a gaming outcome server such as central determinant server 405. Some embodiments use a hardware-based RNG or pseudo-RNG, while others use a software based RNG or pseudo-RNG. In this embodiment, the game engine is the Nitro™ game engine provided by Even Games, Inc., which interacts with a Nitro game server for managing installed games, and various Nitro messaging services for managing group presentations and group mode gaming such as tournaments, tiered bonus gaming modes like those herein, and other group game presentations across multiple gaming machines.

A gaming module storage drive, in this embodiment the Nitro Content drive, holds the software and data structures for providing particular games, embodied in a game module 202. As shown in the drawing, typically the game modules 202 is added to separate module storage drive than the drive which stores EGM game engine, but this is not limiting, and other security measures may instead be used. This separated storage arrangement allows a configuration server to access the module storage drive for configuring the gaming machine.

Game module 202 includes at least first data describing game math for describing the mathematical response to random numbers or randomly generated prizes provided by the prize generator. The game math data in module 202 includes base game and bonus game wager data, and base game and bonus game bonus payout data and definitions of the mathematical probabilities or operations to produce bonus game results based upon random numbers generated for game results. Bonus game data may be provided in a separate game math module in versions having upgradeable bonus games. Game module 202 also includes base game code for executing the logic and rules of the primary game, which is preferably script code such as javascript object notation (JSON) executed by a script engine portion of the game engine, but may in other embodiments be another type of program code such as executable code executed directly by the EGM processor. Outcome scripts are randomly selected to present game results of appropriate prize amounts in implementations with a prize first architecture. Game module 202 also includes base game media assets with digital media data including graphics and audio for all media features and sequences to be employed for executing the primary game results and any related media presentations.

Depicted below the base game code are bonus feature media assets and bonus feature code for executing bonus features such as bonus awards displayed in secondary display area 58, for example. Bonus features graphics and audio media are included and along with celebration graphics and audio for presenting bonus awards. The media assets include the bonus gaming mode graphics and audio, such as the prize object graphics and animations for presenting the tired bonus game described herein. The bonus feature code is executed to operate the bonus gaming mode and conduct the bonus feature steps of FIG. 15 for some embodiments which provide a tiered bonus. A set of outcome scripts is included which provided scripted outcomes operating the bonus game graphical objects such as the bonus feature prize selector and bonus feature control selector. The bonus game code may obtain progressive prize amounts from a progressive server for embodiments that provide a tiered progressive game such as that depicted in FIGS. 1-14. As discussed above, bonus outcomes or progressive bonus outcomes may be generated separately from base game outcomes with a random determination specific to a bonus/progressive bonus game, or may be part of the base game outcome.

Progressive feature code is also included to implement progressive game features such as the tiered progressive prize bonus game shown herein. Progressive feature code includes code to conduct and present the game as shown in FIG. 15, and also to interact with a progressive server using messaging to manage prize award values and accounting.

In this embodiment, the progressive server game messaging service plugin is a service running on a progressive server 407 or other suitable messaging server for coordinating progressive award activity. The messaging service plugin includes messaging code for sending and receiving messages with messaging plugins on all gaming machines in a designated group. Prize tracking code tracks the state of prize objects in the bonus game, receiving messages indicating prize objects have been awarded, recording the state of the prize objects, and sending messages to the set of gaming machines that prize objects have been taken.

A central determinant server 405 is included for versions which obtain game results from such a server rather than randomly generating results locally at the depicted prize generator. Central determinant server 405 may be configured to determine lottery, bingo, or other centrally determined game outcomes and provide the information to networked gaming machines 100 providing lottery and bingo-based wagering games to patrons. Central determinant server 405 includes EGM participation tracking code which manages the login and authorization of gaming machines, including which games the gaming machines are participating in. Also included is RNG and prize selection code which generates random numbers, possibly with a hardware based RNG or pseudo-RNG, and selects game outcomes based on the results. The game outcomes may be generated randomly, but in preferred embodiments are randomly selected from an outcome pool having the desired mathematical distribution of outcomes. Central determinant server 405 also includes win tracking code to track game wins, and messaging code to communicate with the various EGMs.

Referring again to gaming module 202, a module digest is typically including a content GUID (global unique identifier), game and version information, and data needed to validate the game module at installation and startup.

Referring again to FIG. 15, the process is generally controlled by the system processor by executing program code, executable by a gaming machine or gaming network processor, to accomplish the functionality as described herein. It should be understood that this is only one example embodiment, and other versions may divide the processing tasks of the game method in a different manner. For example, some systems may employ a thin client architecture in which practically all of the processing tasks are performed at the game server, and only display information for the player interface transmitted to the electronic gaming machine. In such an embodiment, only the steps involving player input or display are performed by the electronic gaming machine, with the remaining steps performed by one of the game servers in the system. In such a case, though, the software architecture is preferably designed as a thin client in which a dedicated virtual machine running on the game server (or a virtual machine server connected in the gaming network) performs the tasks designated in the present drawing as occurring "at the gaming machine." In the depicted flowchart, the method is performed by the respective computer hardware operating under control of computer program code. While central processor arrangements may vary (for example award controllers may be integrated on the same machine with a gaming server, or may be a separate server connected on a secure network), the particular central determinant architecture is not limiting and will be referred to generally in this drawing as the game server (403). To perform the base game and tiered progressive bonus game, the thin client version of the process, performed at the game server, further includes receiving game play requests originating from electronic gaming machine, and sending commands to the gaming machine to show reels spinning, the bonus wheel and control wheel, the bonus round selection process, and results being displayed. The division of game logic steps between gaming machines and servers is known in the art and may be accomplished according to suitable methods allowed for the relevant gaming jurisdictions.

Figure 18:
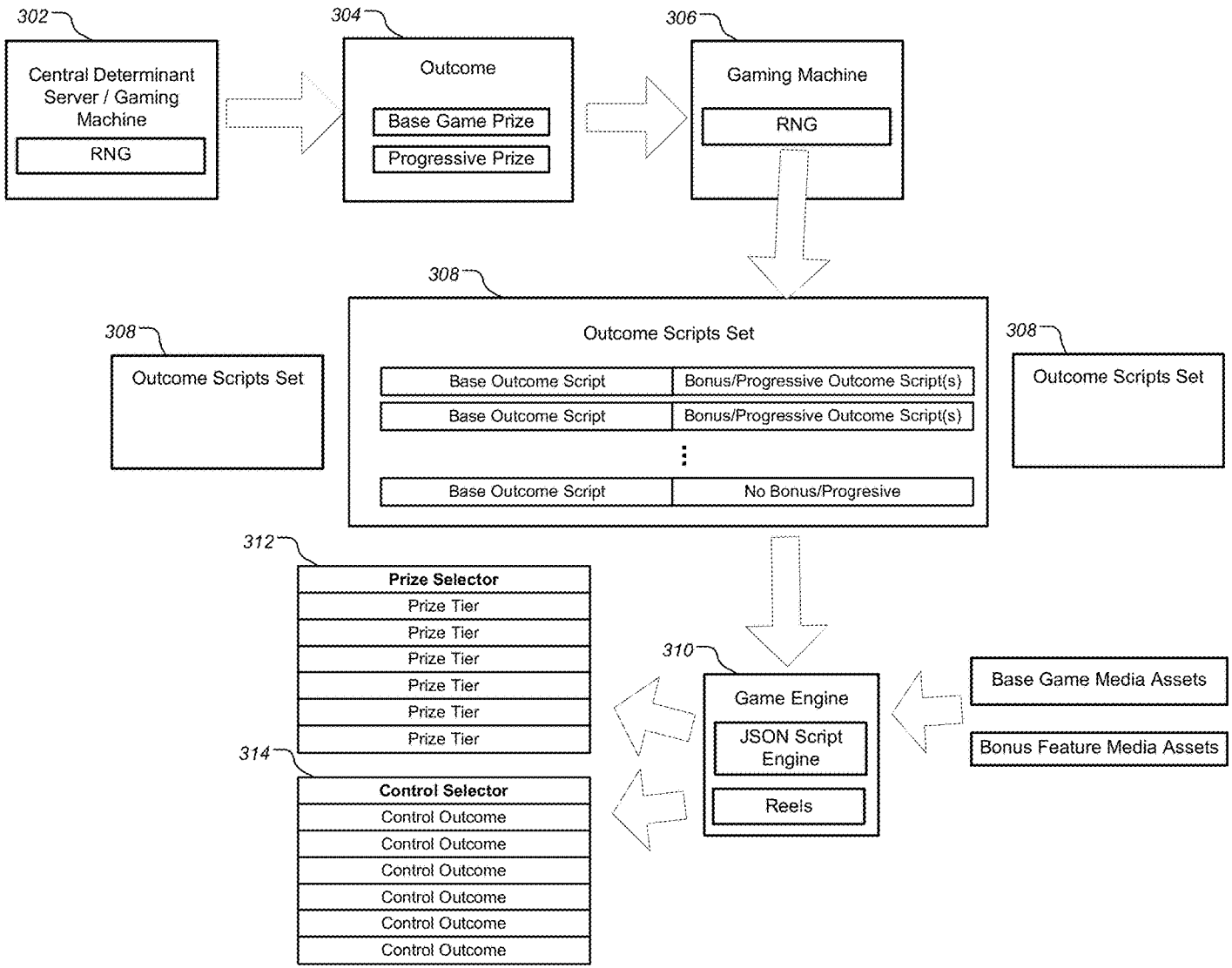
FIG. 18 shows a block diagram of software and data structures performing operations employed in operating a tiered bonus game according to some embodiments.

FIG. 18 shows a block diagram of software and data structures performing operations employed in operating a tiered bonus game according to some embodiments. In response to a wager activation (FIG. 15, block 1504), at block 302 a random number generation is performed, either at central determinant server or the gaming machine. For centralized gaming architectures such as class II type games or lotto-based games, the central determinant server performs this step. For class III type games, typically an RNG on the gaming machines performs this step. The RNG may be a hardware-based RNG conforming to local regulations for both security and random distribution of outcomes.

At block 304, the random number is employed to select an outcome. Typically the outcome is by using the random number to index or access a pool of outcomes having a distribution of prizes which correlates to the desired game math characteristics for the game, including prize distribution and payout percentages. The selected outcome has a possibility of including only a base game prize and a possibility of including a base game prize and a tiered bonus prize or tiered progressive prize. The typically outcome includes the prize amount for the base game outcome, which may be zero, and the prize amount for the tiered bonus/progressive game outcome, which may be zero.

As shown at block 306, the gaming machine next employs this outcome to operate the game and provide a result. If a central determinant server is used, the outcome is passed to the gaming machine at block 306. If a local RNG is used to select an outcome, the gaming machine is in possession of the outcome. As depicted by the arrow from block 306, the gaming machine uses the prize amount selects a set of outcome scripts 308 from among a group of such sets, each group containing outcome scripts for operating the gaming machine to provide a particular prize amount. The selected set 308 includes multiple scripts which are executable to operate the gaming machine to provide the prize amounts in the outcome in various forms. For example, if the outcome is a base game prize of 200 credits, and no bonus prize, the selected set 308 contains a set of scripts for operating the gaming machine to provide 200 credits through a base game outcome. If the outcome is a base game prize of 100 credits and a bonus game prize of 200 credits, the selected set 308 contains a set of scripts for operating the gaming machine to provide this combination of prizes, each script including base game scripting and tiered bonus or tiered progressive game scripting. From this set, the gaming machine RNG is employed to generate a random number which is used to index the set 308 to select one of the scripts for execution. In some embodiments, further variation is provided for the tiered bonus/progressive prize by generating an additional RNG to determine whether to present the tiered bonus/progressive prize as a single prize or multiple prizes. The selected script may include a base game script and a bonus game script, or only a base game script, as shown by the depicted outcome including a base outcome script and "No Bonus/Progressive".

As shown at block 310, the selected script is then loaded to a game engine to operate the gaming machine to provide the outcome. In a preferred embodiment, a JSON script engine is employed to execute the script. The JSON script engine accesses media assets from the game module (FIG. 17) such as base game media assets and tiered bonus/progressive feature media assets. It executes the base game outcome script using data structures for simulated reels, typically using a set of reel stops provided in the script to implement the base game prize amount. As described above, some base game outcome scripts include a trigger pattern awarding one of the tiered bonus awards (typically the lower award) inside the base game without triggering the tiered bonus/progressive prize display sequence. Such outcomes do not include a bonus/progressive outcome script.

The JSON script engine also executes the tiered bonus/progressive outcome script(s) which access data structures including a bonus feature prize selector array 312 and a bonus feature control selector array 314. In this embodiment, a prize selector array 312 and a control selector array 314 are tied to the graphic media assets that execute to display the bonus feature prize selector, which in this embodiment is a first bonus wheel 65 (FIG. 1), and the bonus feature control selector, which in this embodiment is a control wheel 67.

The various prize tiers in prize selector array 312 are linked to the bonus feature prize tiers, which are selected and modified as described with respect to FIG. 15. To remove prize tiers from the bonus feature prize selector, the script alters the array to command the media assets to display a prize tiers (such as a segment of first bonus wheel 65) being removed.

The control outcomes in control selector array 314 are linked to the displayed control outcomes, which in this embodiment are the UPGRADE and AWARD outcomes on control wheel 67. To alter control outcomes as described with respect to FIG. 15, the script alters the respective control outcome entry in control outcome array 314, which causes the graphic media asset to alter the control outcome selector implemented in this embodiment as control wheel 67. Media assets such as bonus celebration and audio assets are also accessed in presenting the tiered bonus/progressive prize after the bonus/progressive outcome script operates the gaming machine to implement the tiered bonus/progressive sequence as described above.

FIG. 19 shows a hardware and logical block diagram 200 of gaming machine 100 which includes a central processing unit (CPU) 205 along with random access memory 206 and nonvolatile memory or storage device 207. All of these devices are connected on a system bus 208 with an audio controller 209, a network controller 210, and a serial interface 211. A graphics processor 215 is also connected on system bus 208 and is connected to drive primary video display device 104 (mounted in cabinet 101 as shown in FIG. 16). A second graphics processor 216 is also connected on system bus 208 in this example to drive the auxiliary display device 109 also shown in FIG. 16. Gaming machine 100 also includes a touch screen controller 217 connected to system bus 208. Touch screen controller 217 is also connected via signal path 218 to receive signals from a touchscreen element associated with primary video display device 104. It will be appreciated that the touchscreen element itself typically comprises a thin film that is secured over the display surface of primary video display device 104. The touchscreen element itself is not illustrated or referenced separately in the figures.

Those familiar with data processing devices and systems will appreciate that other common electronic components will be included in gaming machine 100 such as a power supply, cooling systems for the various system components, audio amplifiers, and other devices that are common in gaming machines. These additional devices are omitted from the drawings so as not to obscure the present invention in unnecessary detail.

All of the elements 205, 206, 207, 208, 209, 210, and 211 shown in FIG. 19 are known elements used in the gaming machine industry. These elements are preferably mounted in a computer chassis which is housed in cabinet 101 shown in FIG. 16. Alternatively, the various electronic components may be mounted on one or more circuit boards or modules housed within cabinet 101 without a separate enclosure. Those familiar with data processing systems and the various data processing elements shown in FIG. 19 will appreciate that many variations on this illustrated structure may be used within the scope of the present invention. For example, since serial communications are commonly employed to communicate with a touch screen controller such as touch screen controller 217, the touch screen controller may not be connected on system bus 208, but instead include a serial communications line to serial interface 211, which may be a USB controller or a IEEE 1394 controller for example. It will also be appreciated that some of the devices shown in FIG. 19 as being connected directly on system bus 208 may in fact communicate with the other system components through a suitable expansion bus. Audio controller 209, for example, may be connected to the system via a PCI bus. System bus 208 is shown in FIG. 19 merely to indicate that the various components are connected in some fashion for communication with game processor/CPU 205 and is not intended to limit the invention to any particular bus architecture. Numerous other variations in the gaming machine internal structure and system may be used without departing from the principles of the present invention.

Although separate graphics processor 215 is shown for controlling primary video display device 104, and graphics processor 216 is shown for controlling both auxiliary display device 109, it will be appreciated that game processor/CPU 205 may control all of the display devices directly without any intermediate graphics processor. The invention is not limited to any particular arrangement of processing devices for controlling the video display device included with gaming machine 100. Also, a gaming machine implementing the present invention is not limited to any particular number of video display devices or other types of display devices.

In the illustrated gaming machine 100, game processor/CPU 205 executes software which ultimately controls the entire gaming machine including the receipt of player inputs and the presentation of the graphic symbols displayed according to the invention through the display devices 104, 107, and 109 associated with the gaming machine. As will be discussed further below, game processor/CPU 205 either alone or in combination with graphics processor 215 may implement a presentation controller for performing functions associated with a primary game that may be available through the gaming machine, and may also implement a game client for directing one or more display devices at the gaming machine to display the feature game mode according to the present invention. Game processor/CPU 205 also executes software related to communications handled through network controller 210, and software related to various peripheral devices such as those connected to the system through audio controller 209, serial interface 211, and touch screen controller 217. Game processor/CPU 205 may also execute software to perform accounting functions associated with game play. Random access memory 206 provides memory for use by game processor/CPU 205 in executing its various software programs, while the nonvolatile memory or storage device 207 may comprise a hard drive or other mass storage device providing storage for programs not in use or for other data generated or used in the course of gaming machine operation. Network controller 210 provides an interface to other components of a gaming system in which gaming machine 100 is included.

It should be noted that the invention is not limited to gaming machines employing the arrangement of processing devices and interfaces shown in example gaming machine 100. Other gaming machines through which the features herein are implemented may include one or more special purpose processing devices to perform the various processing steps for implementing the present invention, such as generating random numbers or checking the security status of software packages or gaming credit vouchers. Unlike processing devices such as game processor/CPU 205, these special purpose processing devices may not employ operational program code to direct the various processing steps.

Still referring to the hardware and logical block diagram 200 showing an example design for a gaming machine 100, the depicted machine in operation is controlled generally by game processor/CPU 205 which stores operating programs and data in non-volatile memory 207 with game module 204, and software or drivers for user interface 220, network controller 210, audio/visual controllers, along with a controller for reel assembly 213 (if a mechanical reel configuration is used). The game module 204, once installed, also is held in non-volatile memory of the EGM, preferably a separate flash drive or hard drive from the memory holding the EGM operating system. CPU or game processor/CPU 205 may comprise a conventional microprocessor, such as an Intel microprocessor, mounted on a printed circuit board with supporting ports, drivers, memory, software, and firmware to communicate with and control gaming machine operations, such as through the execution of coding stored in non-volatile memory 207 including one or primary game modules 202, including executable code and data structures such data structures for performing the primary game in the mode 230, and data structures for performing the primary game in the second, group gaming mode 232. Game processor/CPU 205 connects to user interface 220 such that a player may enter input information, and game processor/CPU 205 may respond according to its programming, such as to apply a wager and initiate execution of a game.

Figure 20:
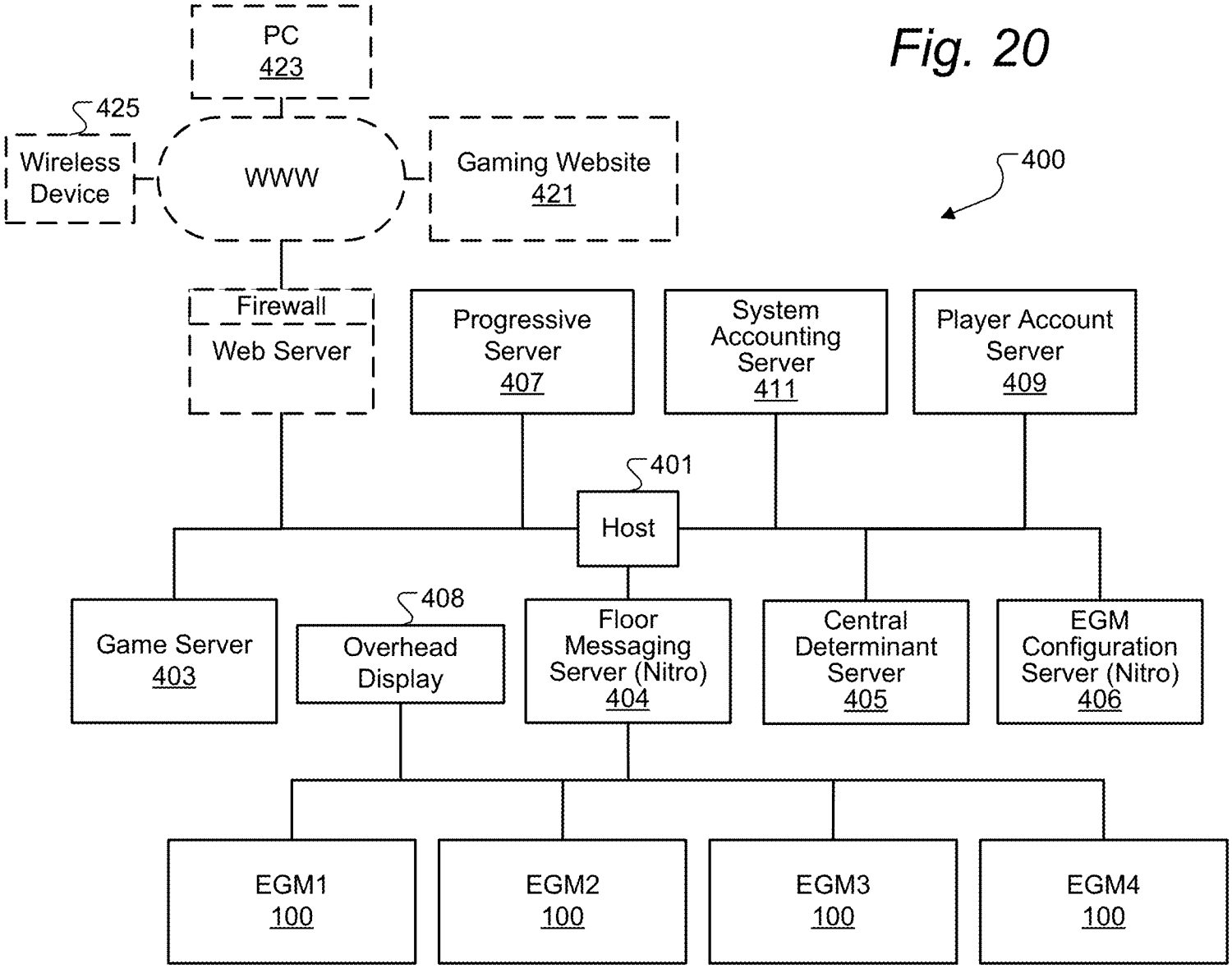
FIG. 20 is a system block diagram of a gaming system according to one embodiment.

Game processor/CPU 205 also may connect through network controller 210 to a gaming network, such as example casino server network 400 shown in FIG. 20. Referring now to FIG. 20, the casino server network 400 may be implemented over one or more site locations and include host server 401, and an EGM configuration server 406 (in the preferred version the Everi Games Nitro Host server) for managing the configuration of multiple EGMs 100 on the network. A group display device 408 is coupled to casino server network 400 may include its own controller and graphics processor for driving the group display in response to commands received over a network connection. The network may also include remote game play server 403 (which may be configured to provide game processor functionality including determining game outcomes and providing audio/visual instructions to a remote gaming device), a floor messaging server 404, central determinant server 405 (which may be configured to determine lottery, bingo, or other centrally determined game outcomes and provide the information to networked gaming machines 100 providing lottery and bingo-based wagering games to patrons), progressive server 407 (which may be configured to accumulate a progressive pool from a portion of wagering proceeds or operator marketing funds and to award progressive awards upon the occurrence of a progressive award winning event to one or more networked gaming machines 100), player account server 409 (which may be configured to collect and store player information and/or awards and to provide player information to gaming machines 100 after receiving player identification information such as from a player card), and accounting server 411 (which may be configured to receive and store data from networked gaming machines 100 and to use the data to provide reports and analyses to an operator). Through its network connection, gaming machine 100 may be monitored by an operator through one or more servers such as to assure proper operation, and, data and information may be shared between gaming machine 100 and respective of the servers in the network such as to accumulate or provide player promotional value, to provide server-based games, or to pay server-based awards. While some of the servers have been shown separately, they may be combined or split into additional servers having additional capabilities.

As shown, networked gaming machines 100 (EGM1-EGM4) and one or more overhead group displays 408 may be network connected and enable the content of one or more displays of gaming machines 100 to be mirrored or replayed on an overhead display. EGMs 100 may also feed celebration graphics directly to the overhead displays 408 in the course of providing games, for example to show a celebration for a large bonus win or group gaming mode win on a particular EGM 100. Typically the overhead display function and group celebration scenarios are managed by a floor messaging server such as Nitro floor messaging server 404, which receives messages from EGM's 100 to communicate group gaming mode wins, bonus game wins, or awards of other large prizes such as progressive prizes. The primary display content may also be stored by the display controller or game processor/CPU 205 and transmitted through network controller 210 to the overhead display controller either substantially simultaneously or at a subsequent time according to either periodic programming executed by game processor/CPU 205 or a triggering event, such as a jackpot or large win, at a respective gaming machine 100. In the event that gaming machines 100 have cameras installed, the respective player's video images may be displayed on overhead display 408 along with the content of the player's gaming machine 100 and any associated audio feed.

In one or more embodiments, game server 403 may provide server-based games and/or game services to network connected gaming devices, such as gaming machines 100 (which may be connected by network cable or wirelessly). Progressive server 407 may accumulate progressive awards by receiving defined amounts (such as a percentage of the wagers from eligible gaming devices or by receiving funding from marketing or casino funds) and provide progressive awards to winning gaming devices upon a progressive event, such as a progressive jackpot game outcome or other triggering event such as a random or pseudo-random win determination at a networked gaming device or server (such as to provide a large potential award to players playing the community feature game). Progressive prizes may be made available to be won through display on the group gaming board in group gaming mode, as they are in base gaming mode. Accounting server 411 may receive gaming data from each of the networked gaming devices, perform audit functions, and provide data for analysis programs, such as the IGT Mariposa program bundle.

Player account server 409 may maintain player account records, and store persistent player data such as accumulated player points and/or player preferences (e. g. game personalizing selections or options). For example, the player tracking display may be programmed to display a player menu that may include a choice of personalized gaming selections that may be applied to a gaming machine 100 being played by the player.

In one or more embodiments, the player menu may be programmed to display after a player inserts a player card into the card reader. When the card reader is inserted, an identification may be read from the card and transmitted to player account server 409. Player account server 409 transmits player information through network controller 210 to user interface 220 for display on the player tracking display. The player tracking display may provide a personalized welcome to the player, the player's current player points, and any additional personalized data. If the player has not previously made a selection, then this information may or may not be displayed. Once the player makes a personalizing selection, the information may be transmitted to game processor/CPU 205 for storing and use during the player's game play. Also, the player's selection may be transmitted to player account server 409 where it may be stored in association with the player's account for transmission to the player in future gaming sessions. The player may change selections at any time using the player tracking display (which may be touch sensitive or have player-selectable buttons associated with the various display selections).

In one or more embodiments, a gaming website may be accessible by players, e.g. gaming website 421, whereon one or more games may be displayed as described herein and played by a player such as through the use of personal computer 423 or handheld wireless device 425 (e.g. Apple iPhone, Android phone, tablet, phablet, virtual reality device, iPad, etc.). To enter the website, a player may log in with a username (that may be associated with the player's account information stored on player account server 409 or be accessible by a casino operator to obtain player data and provide promotional offers), play various games on the website, make various personalizing selections and save the information, so that during a next gaming session at a casino establishment, the player's playing data and personalized information may be associated with the player's account and accessible at the player's selected gaming machine 100.

Referring generally to the description herein, any use of ordinal terms such as "first," "second," "third," etc., to refer to an element does not by itself connote any priority, precedence, or order of one element over another, or the temporal order in which acts of a method are performed. Rather, unless specifically stated otherwise, such ordinal terms are used merely as labels to distinguish one element having a certain name from another element having a same name (but for use of the ordinal term).

Further, as described herein, the various features have been provided in the context of various described embodiments, but may be used in other embodiments. The combinations of features described herein should not be interpreted to be limiting, and the features herein may be used in any working combination or sub-combination according to the invention. This description should therefore be interpreted as providing written support, under U.S. patent law and any relevant foreign patent laws, for any working combination or some sub-combination of the features herein.

The above described preferred embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A method for controlling the operation of a gaming machine, the method including:

(a) in response to a play input entered through a player input device of the gaming machine and under control of a processing system of the gaming machine, causing a display system of the gaming machine to select a base result responsive to a hardware random number generator of the gaming machine and display a base result representation in a first area of the display system;

(b) under control of the processing system, causing the display system to display a bonus feature prize selector, a bonus feature control selector, and a number of bonus feature prize tiers in a second area of the display system separate from the first area of the display system;

(c) in response to a trigger condition for the play input and under control of the processing system, causing the display system to display an operation of the bonus feature prize selector to select a current prize from among the number of bonus feature prize tiers and causing the display system to display an operation of the bonus feature control selector to select a control outcome, the control outcome being selected from a group comprising at least an award outcome and an upgrade outcome;

(d) in response to the selected control outcome comprising the upgrade outcome and under control of the processing system, displaying the bonus feature prize selector being graphically modified to remove one or more prize values equal to or lower than the current prize from the bonus feature prize selector and causing the bonus feature prize selector to replace the current prize with a selection from among a subset of the number of bonus feature prize tiers comprising each bonus feature prize tier having a value higher than a prior value of the current prize; and (e) in response to the selected control outcome comprising the award outcome and under control of the processing system, awarding the current prize.

2. The method of claim 1, further comprising determining if the base result representation corresponds to one of the number of bonus feature prize tiers and, if so, awarding a prize associated with the respective bonus feature prize tier in response to the display of the base result representation, the prize associated with the respective bonus feature prize tier being awarded through the gaming machine under control of the processing system.

3. The method of claim 1, further comprising, in response to the selected control outcome comprising the upgrade outcome, displaying the bonus feature control selector being graphically modified to change the selected upgrade outcome to an award outcome.

4. The method of claim 1, further comprising, in response to the selected control outcome comprising the upgrade outcome and under control of the processing system:

again causing the display system to display an operation of the bonus feature control selector to select a second control outcome, the second control outcome being selected from the group comprising at least an award outcome and an upgrade outcome;

in response to the second control outcome comprising the upgrade outcome and under control of the processing system, causing the bonus feature prize selector to replace the current prize with a selection from among a new subset of the number of bonus feature prize tiers comprising each bonus feature prize tier having a value higher than the updated value of the current prize; and in response to the second control outcome comprising the award outcome and under control of the processing system, awarding the current prize.

5. The method of claim 1, wherein the bonus feature prize selector is a wheel which is spun to select a prize, and the bonus feature control selector is a second wheel which is spun to select a control outcome.

6. The method of claim 5, in which displaying the bonus feature prize selector being graphically modified includes displaying segments of the wheel disappearing and displaying remaining segments growing to fill a greater circumferential span of the wheel.

7. The method of claim 1, wherein the respective bonus prizes are progressive award prizes.

8. A gaming machine comprising:

a display system, an audio device, a player input device, a hardware random number generator (RNG), and at least one electronic controller operatively coupled to the display system, the audio device, the RNG, and the player input device and configured to execute instructions related to a game;

tangible, non-transitory electronically accessible memory coupled to the at least one electronic controller and containing program code executable by the at least one electronic controller for:

(a) in response to a play input entered through the player input device, causing the display system to select and display a base result representation based on a random number from the RNG in a first area of the display system;

(b) while the base result representation is displayed in the first area of the display system, causing the display system to display a bonus feature prize selector, a bonus feature control selector, and a number of bonus feature prize tiers in a second area of the display system separate from the first area of the display system;

(c) in response to a trigger condition for the play input and under control of the at least one electronic controller, causing the display system to display an operation of the bonus feature prize selector to select a current prize from among the number of bonus feature prize tiers and causing the display system to display an operation of the bonus feature control selector to select a control outcome, the control outcome being selected from a group comprising at least an award outcome and an upgrade outcome;

(d) in response to the selected control outcome comprising the upgrade outcome, displaying the bonus feature prize selector being graphically modified to remove one or more prize values equal to or lower than the current prize from the bonus feature prize selector and causing the bonus feature prize selector to replace the current prize with a selection from among a subset of the number of bonus feature prize tiers comprising each bonus feature prize tier having a value higher than a prior value of the current prize; and (e) in response to the selected control outcome comprising the award outcome, awarding the current prize.

9. The gaming machine of claim 8, in which the program code is further executable by the at least one electronic controller for determining if the base result representation corresponds to one of the number of bonus feature prize tiers and, if so, awarding a prize associated with the respective bonus feature prize tier in response to the display of the base result representation, the prize associated with the respective bonus feature prize tier being awarded through the gaming machine.

10. The gaming machine of claim 8, in which the program code is further executable by the at least one electronic controller for, in response to the selected control outcome comprising the upgrade outcome, displaying the bonus feature control selector being graphically modified to change the selected upgrade outcome to an award outcome.

11. The gaming machine of claim 8, in which the program code is further executable by the at least one electronic controller for, in response to the selected control outcome comprising the upgrade outcome:

again causing the display system to display an operation of the bonus feature control selector to select a second control outcome, the second control outcome being selected from the group comprising at least an award outcome and an upgrade outcome;

in response to the second control outcome comprising the upgrade outcome and under control of the at least one electronic controller, causing the bonus feature prize selector to replace the current prize with a selection from among a new subset of the number of bonus feature prize tiers comprising each bonus feature prize tier having a value higher than the updated value of the current prize; and in response to the second control outcome comprising the award outcome and under control of the at least one electronic controller, awarding the current prize.

12. The gaming machine of claim 8, wherein the bonus feature prize selector is a wheel which is spun to select a prize, and the bonus feature control selector is a second wheel which is spun to select a control outcome.

13. The gaming machine of claim 12, in which displaying the bonus feature prize selector being graphically modified includes displaying segments of the wheel disappearing and displaying remaining segments growing to fill a greater circumferential span of the wheel.

14. A tangible, non-transitory computer readable medium holding a program product for execution by a controller of a gaming machine, the program product including machine instruction program code for:

(a) in response to a play input entered through a player input device of the gaming machine, selecting a base result based on accessing a hardware random number generator (RNG) of the gaming machine and causing a display system of the gaming machine to display a base result representation in a first area of the display system;

(b) while the base result representation is displayed in the first area of the display system, causing the display system to display a bonus feature prize selector, a bonus feature control selector, and a number of bonus feature prize tiers in a second area of the display system separate from the first area of the display system;

(c) in response to a trigger condition for the play input, causing the display system to display an operation of the bonus feature prize selector to select a current prize from among the number of bonus feature prize tiers and causing the display system to display an operation of the bonus feature control selector to select a control outcome, the control outcome being selected from a group comprising at least an award outcome and an upgrade outcome;

(d) in response to the selected control outcome comprising the upgrade outcome, displaying the bonus feature prize selector being graphically modified to remove one or more prize values equal to or lower than the potential bonus prize from the bonus feature prize selector and causing the bonus feature prize selector to replace the current prize with a selection from among a subset of the number of bonus feature prize tiers comprising each bonus feature prize tier having a value higher than a prior value of the current prize; and (e) in response to the selected control outcome comprising the award outcome, awarding the current prize.

15. The medium holding a program product of claim 14, in which the program code is further executable for determining if the base result representation corresponds to one of the number of bonus feature prize tiers and, if so, awarding a prize associated with the respective bonus feature prize tier in response to the display of the base result representation, the prize associated with the respective bonus feature prize tier being awarded through the gaming machine.

16. The medium holding a program product of claim 14, in which the program code is further executable for, in response to the selected control outcome comprising the upgrade outcome:

again causing the display system to display an operation of the bonus feature control selector to select a second control outcome, the second control outcome being selected from the group comprising at least an award outcome and an upgrade outcome;

in response to the second control outcome comprising the upgrade outcome and under control of the processing system, causing the bonus feature prize selector to replace the current prize with a selection from among a new subset of the number of bonus feature prize tiers comprising each bonus feature prize tier having a value higher than the updated value of the current prize; and in response to the second control outcome comprising the award outcome and under control of the processing system, awarding the current prize.

17. The medium holding a program product of claim 14 wherein:

the bonus feature prize selector is a wheel which is spun to select a prize, and the bonus feature control selector is a second wheel which is spun to select a control outcome; and wherein displaying the bonus feature prize selector being graphically modified includes displaying segments of the wheel disappearing and displaying remaining segments growing to fill a greater circumferential span of the wheel.

* * * * *